US010989001B2

(12) United States Patent
Steele et al.

(10) Patent No.: US 10,989,001 B2
(45) Date of Patent: Apr. 27, 2021

(54) PLUG DEFLECTOR FOR ISOLATING A WELLBORE OF A MULTI-LATERAL WELLBORE SYSTEM

(71) Applicant: Halliburton Energy Services, Inc., Houston, TX (US)

(72) Inventors: David Joe Steele, Arlington, TX (US); Benjamin Luke Butler, Houston, TX (US); Stuart Alexander Telfer, Central Scotland (GB); Neil Hepburn, Tyne and Wear (GB)

(73) Assignee: Halliburton Energy Services, Inc., Houston, TX (US)

( * ) Notice: Subject to any disclaimer, the term of this patent is extended or adjusted under 35 U.S.C. 154(b) by 18 days.

(21) Appl. No.: 16/324,785

(22) PCT Filed: Sep. 16, 2016

(86) PCT No.: PCT/US2016/052177
§ 371 (c)(1),
(2) Date: Feb. 11, 2019

(87) PCT Pub. No.: WO2018/052439
PCT Pub. Date: Mar. 22, 2018

(65) Prior Publication Data

US 2019/0186222 A1 Jun. 20, 2019

(51) Int. Cl.
*E21B 23/12* (2006.01)
*E21B 33/12* (2006.01)
(Continued)

(52) U.S. Cl.
CPC ..... *E21B 23/12* (2020.05); *E21B 33/12* (2013.01); *E21B 41/0035* (2013.01); *E21B 47/024* (2013.01)

(58) Field of Classification Search
CPC .. E21B 2033/105; E21B 33/105; E21B 7/061; E21B 23/002; E21B 41/0035; E21B 47/024; E21B 33/12
See application file for complete search history.

(56) References Cited

U.S. PATENT DOCUMENTS 5,353,876 A 10/1994 Curington et al.
6,019,173 A 2/2000 Saurer et al.
(Continued)

FOREIGN PATENT DOCUMENTS

SU 981556 A1 12/1982
WO 2013043127 3/2013

OTHER PUBLICATIONS

ISRWO International Search Report and Written Opinion for PCT/US2016/052177 dated Sep. 16, 2016.
(Continued)

*Primary Examiner* — Kristyn A Hall
*Assistant Examiner* — Dany E Akakpo
(74) *Attorney, Agent, or Firm* — Scott Richardson; C. Tumey Law Group PLLC

(57) ABSTRACT

A plug deflector includes a body having a first end and a second end opposite the first end, a tool receptacle provided at the first end and defining an internal bore having a first coupling mechanism defined on the internal bore, at least one plug provided at the second end, and a deflector surface provided at an intermediate location between the first and second ends. A system includes a Y-block positioned within a multi-lateral wellbore at a junction of a first wellbore and a second wellbore extending from the first wellbore, the Y-block having a first leg fluidly coupled to the first wellbore and a second leg fluidly coupled to the second wellbore, and a plug deflector coupled to the Y-block.

26 Claims, 19 Drawing Sheets

(51) Int. Cl.
*E21B 41/00* (2006.01)
*E21B 47/024* (2006.01)

(56) References Cited

U.S. PATENT DOCUMENTS

| | | | | |
|---|---|---|---|---|
| 6,564,867 | B2 | 5/2003 | Ohmer | |
| 6,935,422 | B2 | 8/2005 | Steele et al. | |
| 6,994,165 | B2 | 2/2006 | Roane et al. | |
| 2004/0007389 | A1* | 1/2004 | Zupanick ..... | E21B 7/061 175/61 |
| 2005/0061511 | A1 | 3/2005 | Steele | |
| 2013/0192840 | A1 | 8/2013 | Wolf et al. | |
| 2014/0166367 | A1* | 6/2014 | Campbell ..... | E21B 25/00 175/58 |

OTHER PUBLICATIONS

Halliburton Energy Services, Inc., "IsoRite® Isolated Multilateral Completion Systems" for Multilateral Wells That Require Re-Entry Capability to Access the Lateral, Brochure H02578 Nov. 2018.
Russian Search Report for Application No. 2019104302 dated Dec. 12, 2019.

* cited by examiner

PLUG DEFLECTOR FOR ISOLATING A WELLBORE OF A MULTI-LATERAL WELLBORE SYSTEM

BACKGROUND

A multi-lateral wellbore system includes at least one lateral wellbore drilled off a main wellbore for the purpose of exploration or extraction of natural resources, such as hydrocarbons. Lateral wellbores are drilled from the main wellbore to target multiple hydrocarbon-bearing zones for purposes of producing oil and gas from subsurface formations. Various downhole tools may be inserted into the main wellbore and/or the lateral wellbore to extract the hydrocarbons from the wellbore and/or to maintain the wellbore during production.

It is frequently required to isolate either the main wellbore or one of the lateral wellbores of a multi-lateral wellbore system while performing operations in other areas of the multi-lateral wellbore system. While isolating one of the main wellbore or lateral wellbores, it may also be required to deflect tools/equipment into the non-isolated portions of the main or lateral wellbores to perform downhole operations therein.

BRIEF DESCRIPTION OF THE DRAWINGS

The following figures are included to illustrate certain aspects of the present disclosure, and should not be viewed as exclusive examples. The subject matter disclosed is capable of considerable modifications, alterations, combinations, and equivalents in form and function, without departing from the scope of this disclosure.

DETAILED DESCRIPTION

The present disclosure is related to downhole tools for use in a wellbore environment and, more particularly, to assemblies used to isolate portions of a multi-lateral wellbore. Examples described herein are directed to a plug deflector that may be used in a multi-lateral wellbore system to isolate portions of a wellbore, such as a main wellbore, while performing operations in other portions of the wellbore, such as a lateral wellbore extending from the main wellbore. The plug deflector may also be used to deflect tools/equipment into the other portions of the wellbore in which downhole operations are to be performed. Since it is designed to isolate a main wellbore and deflect tools into a corresponding lateral wellbore, the plug deflector advantageously combines two or more downhole tools into a single tool, thereby reducing the number of downhole tools required, the time required to perform wellbore operations, and the associated costs of performing the wellbore operations.

Figure 1:
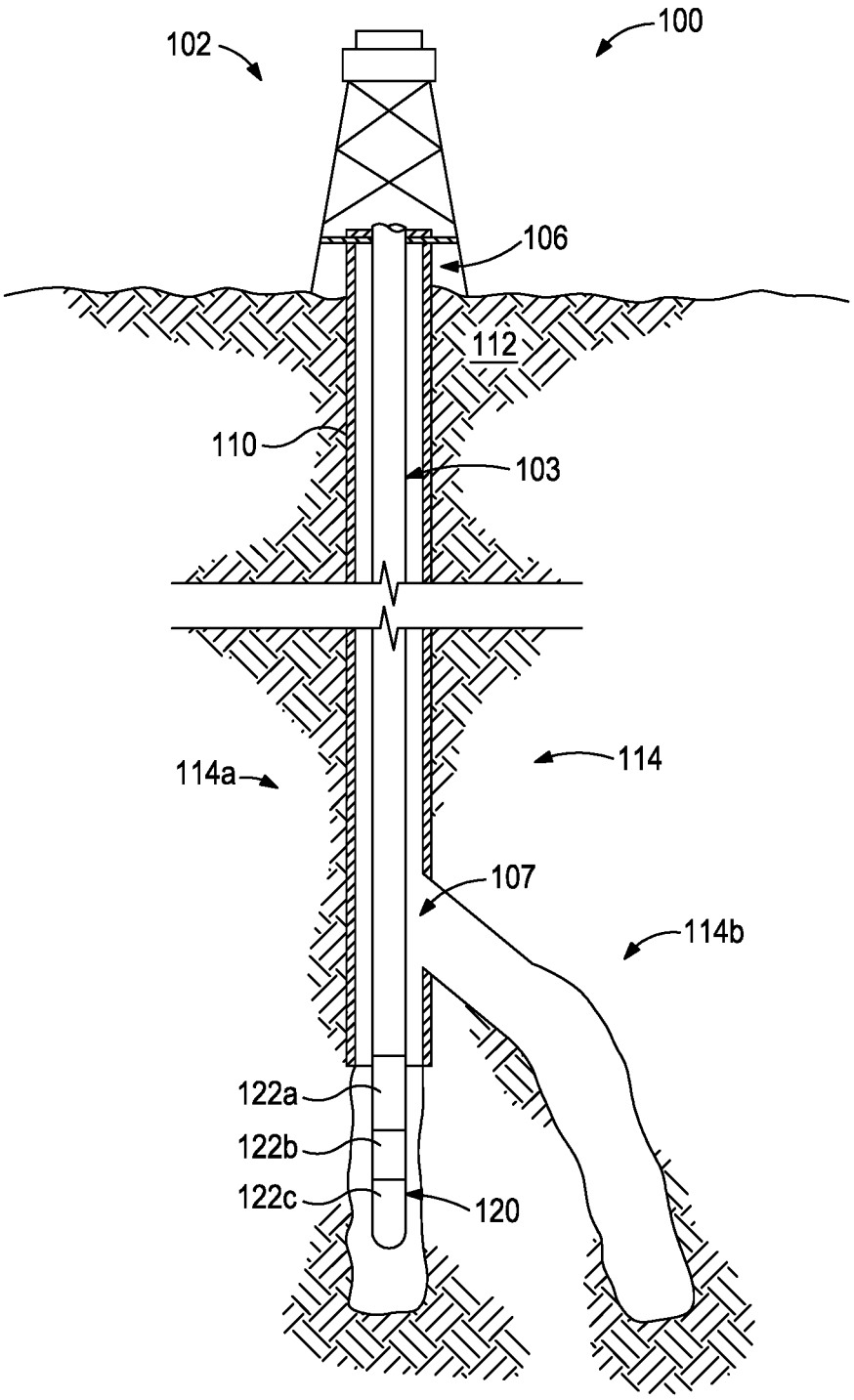
FIG. 1 is an elevation view of a well system that can incorporate the principles of the present disclosure.

FIG. 1 is an elevation view of a well system 100 that can incorporate the principles of the present disclosure. Various types of equipment such as a drilling rig, a completion rig, a workover rig, another type of well construction or servicing device, or a combination of these may be located at a well surface 106. For example, a land-based drilling rig 102 may be located on the surface 106, but it will be appreciated that the principles of the present disclosure could equally apply to any sea-based or sub-sea application where the drilling rig 102 may be replaced with a well construction or servicing rig installed on a floating platform, a semi-submersible platform, a sub-surface wellhead installation, or other sea-based structures (e.g., a jackup rig, a leg platform rig, a production platform, a drill ship, etc.).

The well system 100 may also include a production string 103, which may be used to produce hydrocarbons such as oil and gas and other natural resources (e.g., water) from one or more subterranean formations 112 via a multi-lateral wellbore 114. The subterranean formation(s) 112 can include all or part of one or more subsurface layers (not explicitly illustrated) that are penetrated by the multi-lateral wellbore 114. The subsurface layers can include sedimentary layers, rock layers, sand layers, or combinations thereof, and other types of subsurface layers. One or more of the subsurface layers can contain fluids, such as brine, oil, gas, etc. As illustrated, the multi-lateral wellbore 114 includes a main wellbore 114*a* and a lateral wellbore 114*b* extending from the main wellbore 114*a* at a junction 107 between the two wellbores. The main wellbore 114*a* is substantially vertical (e.g., substantially perpendicular to the surface 106) and the lateral wellbore 114*b* extends from the main wellbore 114*a* at an angle offset from vertical. In any example, portions of the main wellbore 114*a* may be substantially horizontal (e.g., substantially parallel to the surface 106) or may extend at an angle between vertical (e.g., perpendicular to the surface) and horizontal (e.g., parallel to the surface). Similarly, portions of the lateral wellbore 114*b* may be substantially vertical (e.g., substantially perpendicular to the surface 106), substantially horizontal (e.g., substantially parallel to the surface), or at an angle between vertical (e.g., perpendicular to the surface) and horizontal (e.g., parallel to the surface). Although not explicitly illustrated in FIG. 1, one or more "branches" may extend from the lateral wellbore 114*b*. Additionally, one or more "twigs" or "splays" may extend from the one or more "branches." It should be noted that examples described herein are equally applicable to a multi-lateral wellbore configuration that includes the aforementioned "branches" and/or "twigs," without departing from the scope of the disclosure.

A casing string 110 may be secured within the main wellbore 114*a* with cement, which may be injected between the casing string 110 and the inner wall of the main wellbore 114*a*. The casing string 110 and cement provide radial support to the main wellbore 114*a* and cooperatively seal against unwanted communication of fluids between the main wellbore 114*a* and the surrounding formation(s) 112. The casing string 110 may extend from the well surface 106 to a downhole location within the main wellbore 114*a*. Portions of the main wellbore 114*a* that do not include the casing string 110 may be described as "open hole."

As illustrated, the lateral wellbore 114*b* may not be lined with casing and may thus be referred to as an "open hole" lateral wellbore 114*b*. The junction 107 of the main wellbore 114*a* and the lateral wellbore 114*b* may conform with one of the levels defined by the Technology Advancement for Multilaterals (TAML) Organization, for example a TAML Level 5 junction. However, it should be noted that any example disclosed herein can be implemented in junctions conforming to TAML Levels 2, 3, and 4 without departing from the scope of the disclosure.

The terms "uphole" and "downhole" may be used to describe the location of various components relative to the bottom or end of the multi-lateral wellbore 114 shown in FIG. 1. For example, a first component described as uphole from a second component is located further away from the bottom or end of the multi-lateral wellbore 114 than the second component. Similarly, a first component described as being downhole from a second component is located closer to the bottom or end of the multi-lateral wellbore 114 than the second component.

The well system 100 may also include a downhole assembly 120 coupled to the production string 103. The down hole assembly 120 may be used to perform operations relating to the completion of the main wellbore 114*a*, the production of natural resources from the formation 112 via the main wellbore 114*a*, and/or the maintenance of the main wellbore 114*a*. Additionally, in some examples, the downhole assembly 120 may also be used to inject water, gas, or other fluids into the formation 112 from the main wellbore 114*a* for various purposes. The downhole assembly 120 may be formed from a wide variety of components configured to perform these operations. For example, the components 122*a*, 122*b*, and 122*c* of the downhole assembly 120 may include, but are not limited to, one or more well screens, a flow control device (e.g., an in-flow control device (ICD), a flow control valve, etc.), a guide shoe, a float shoe, a float collar, a sliding sleeve, a downhole permanent gauge, a landing nipple, a perforating gun, and a fluid loss control device. The number and types of components 122*a-c* included in the downhole assembly 120 may depend on the type of wellbore, the operations being performed in the wellbore, and anticipated wellbore conditions.

Although the downhole assembly 120 is illustrated in the main wellbore 114*a* in FIG. 1, the downhole assembly 120 may also be used in the lateral wellbore 114*b*. For instance, the downhole assembly 120 may be used to perform completion and production operations in the lateral wellbore 114*b*, undertake maintenance of the lateral wellbore 114*b*, and/or inject water, gas, or other fluids into the formation 112 from the lateral wellbore 114*b* for various purposes.

Figure 2:
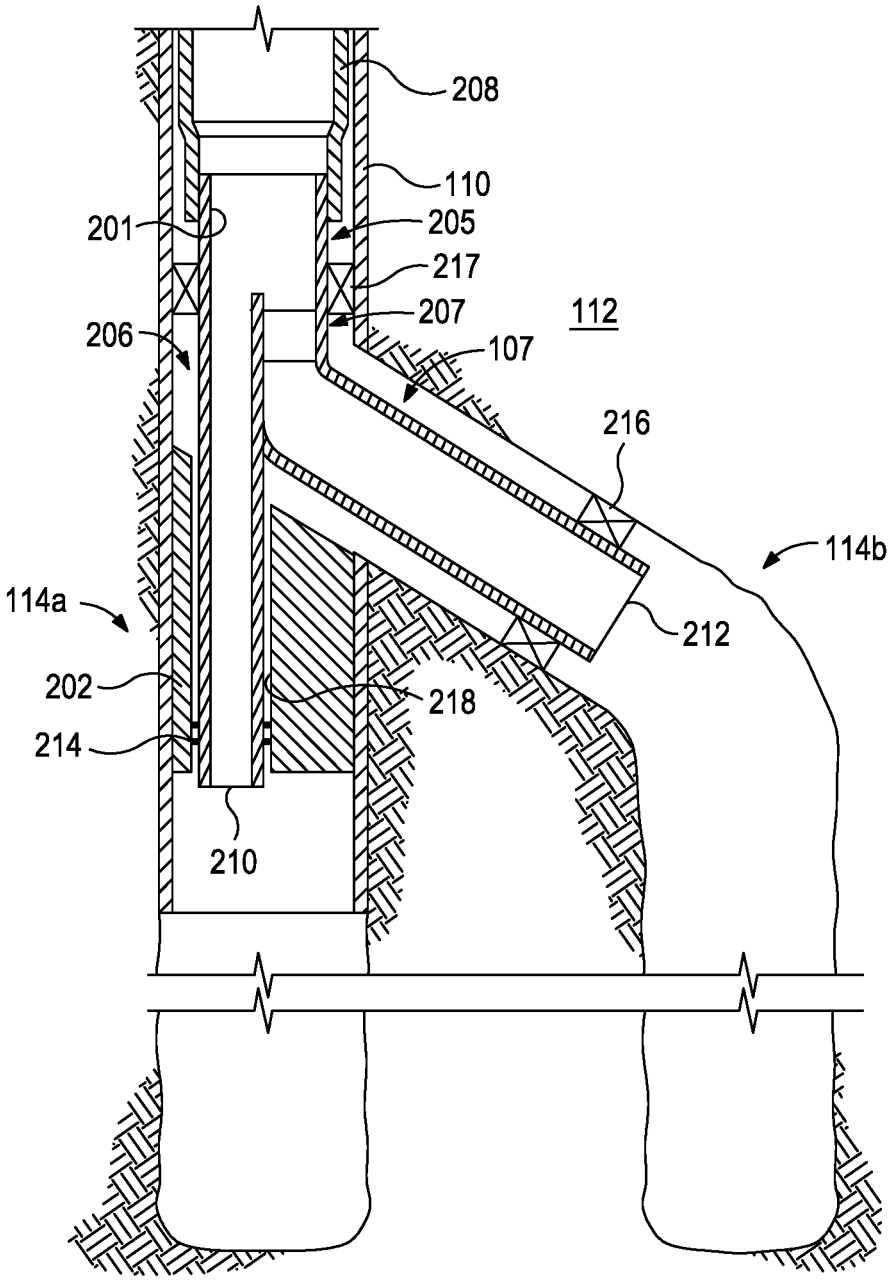
FIG. 2 is a cross-sectional view of a Y-block installed at the intersection of a main wellbore and a lateral wellbore of the well system of FIG. 1.

FIG. 2 is an enlarged cross-sectional view of the well system 100 of FIG. 1 and, more particularly, of a Y-block 206 installed at the junction 107 of the main wellbore 114*a* and the lateral wellbore 114*b*. The illustrated Y-block 206 may be employed in the junction 107 to conform to a TAML Level 5 junction; however, the Y-block 206 may alternatively be employed in other types of junctions, without departing from the scope of the disclosure. The Y-block 206 may be installed to seal and maintain fluid pressure in the main wellbore 114*a* and the lateral wellbore 114*b*. The uphole end of the Y-block 206 may include a single passage section 205 that defines an internal passage 201. The uphole end of the Y-block 206 may be coupled to a liner 208 that extends uphole from the Y-block 206 and thereby forms a fluid and pressure tight seal. The Y-block 206 may include one or more packers 217 at the uphole end that interpose the casing string 110 and the Y-block 206. The downhole end of the Y-block 206 may include a plural passage section 207 that includes two legs, shown as a first or main leg 210 and a second or lateral leg 212. The main leg 210 may be configured to extend into the main wellbore 114*a* and sealingly engage a deflector tool 202 secured within the main wellbore 114*a*. More specifically, the main leg 210 may be configured to extend into a bore 218 defined through the deflector tool 202 and may include seals 214 that sealingly engage the bore 218 to form a fluid and pressure tight seal. Alternatively, the seals 214 may be carried within the bore 218 to sealingly engage the outer radial surface of the main leg 210 as it is "stung" into the bore 218.

Although not explicitly illustrated, a main completion string may be installed and fluidly coupled to the distal end of the main leg 210. The main completion string extends deeper into the main wellbore 114*a* and may include various completion equipment such as perforators, filter assemblies, flow control valves, downhole permanent gauges, hangers, packers, crossover assemblies, completion tools, and the like.

The deflector tool 202 may comprise a whipstock device used for deflecting a cutting tool (e.g., a mill, a drill bit, etc.) to drill the lateral wellbore 114*b*. In any example, the deflector tool 202 may be run into the main wellbore 114*a* and set at the appropriate position for deflecting a completion tool into the lateral wellbore 114*b*. In any example, the deflector tool 202 may comprise a combination whipstock/deflector capable of performing both the operations of a whipstock device and a completion deflector in a single run into the main wellbore 114*a*.

The lateral leg 212 may be deflected off the deflector tool 202 and thereby extend into the lateral wellbore 114*b*. Although not explicitly illustrated, a lateral completion string may be installed and fluidly coupled to the distal end of the lateral leg 212. The lateral completion string extends deeper into the lateral wellbore 114*b* and may include perforators, filter assemblies, flow control valves, downhole permanent gauges, hangers, packers, crossover assemblies, completion tools, and the like.

In the lateral wellbore 114*b*, the lateral leg 212 may be configured to form a sealed engagement with the surrounding wall of the open hole lateral wellbore 114*b* to form a fluid and pressure tight seal. To accomplish this, as illustrated, the lateral leg 212 may include one or more swell packers 216 that interpose the open hole lateral wellbore

114*b* and the lateral leg 212 to form a fluid and pressure tight seal. In any example, an alternative sealing mechanism may be used. Once the Y-block 206 is properly installed and engaged with both the deflector tool 202 and the open hole lateral wellbore 114*b*, a fluid and pressure tight seal is generated across both the main wellbore 114*a* and the lateral wellbore 114*b*.

At various times during production and/or maintenance operations within the multi-lateral wellbore 114, the main wellbore 114*a* or the lateral wellbore 114*b* may need to be temporarily isolated from pressure and/or debris caused by operations occurring in the other branch of the multi-lateral wellbore 114. Examples of such operations include, but are not limited to, gravel packing, fracture packing, acid stimulation, conventional hydraulic fracture treatments, cementing a casing or liner, or other similar operations. As described herein, a plug deflector (not shown) may be installed in the main leg 210 of the Y-block 206 to isolate the main leg 210 from debris and pressure while performing operations in the lateral leg 212. Alternatively, the plug deflector may be installed in the lateral leg 212 of the Y-block 206 to isolate the lateral leg 212 from debris and pressure while performing operations in the main leg 210.

Figure 3A:
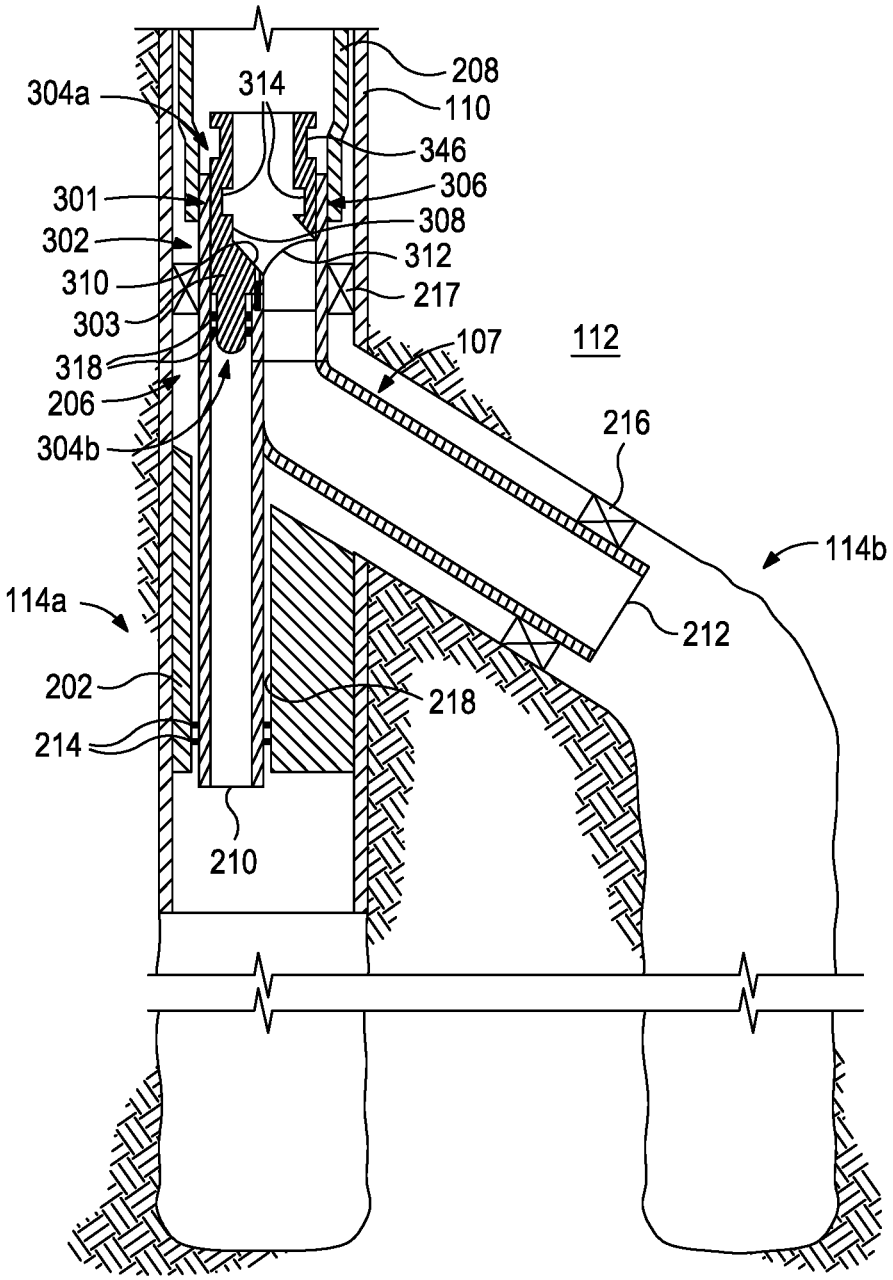
FIG. 3A illustrates a plug deflector installed in the Y-block of FIG. 2.

FIG. 3A illustrates an exemplary plug deflector 302 installed in the Y-block 206. As illustrated, the plug deflector 302 is positioned in the main leg 210 of the Y-block 206 and may be used to isolate the lower portions of the main wellbore 114*a* from debris and pressure stemming from operations undertaken in the lateral wellbore 114*b*. It will be understood by one skilled in the art that the plug deflector 302 may alternatively be positioned in the lateral leg 212 and may be used to isolate the lateral leg 212 while performing operations in the main wellbore 114*a*. Further, in any example disclosed, the plug deflector 302 may be installed in a branch extending from a lateral wellbore to isolate the branch while performing operations in the lateral wellbore. Alternatively, the plug deflector 302 may be installed in the lateral wellbore to isolate the lateral wellbore while performing operations in the branch. Still further, in any example disclosed, the plug deflector 302 may be installed in a twig (or splay) extending from a branch of a lateral wellbore of a multi-lateral wellbore to isolate the twig while performing operations in the branch. Alternatively, the plug deflector 302 may be installed in the branch to isolate the branch while performing operations in the twig. As such, it will be understood by one skilled in the art that the plug deflector 302 may be installed in any desired location in the multi-lateral wellbore, without departing from the scope of the disclosure.

As illustrated, the plug deflector 302 may include an elongated body 303 having a first end 304*a* and a second end 304*b* opposite the first end 304*a*. The body 303 may provide a tool receptacle 306 at the first end 304*a*, which may comprise a generally annular structure that defines an internal bore 308 configured to receive a downhole tool (not shown) during operation. The tool receptacle 306 may provide a coupling mechanism 314 used to receive and otherwise couple the downhole tool to the plug deflector 302. In any example, the coupling mechanism 314 may comprise an annular groove defined within the internal bore 308 at or adjacent the first end 304*a*. The coupling mechanism 314 is not restricted to any particular shape or size and may have a desired shape and size via which the plug deflector 302 can be installed and/or removed from the Y-block 206. In any example, however, the coupling mechanism 314 may comprise other types of coupling means, such as a collet device, a unique profiled engagement surface, and the like.

In some examples, an outer coupling mechanism 346 may be defined on an outer surface of the plug deflector 302 adjacent the first end 304*a* and may be used to receive and otherwise couple a downhole tool (not illustrated) to the plug deflector 302. In an example, as illustrated, the outer coupling mechanism 346 may be an annular groove or profile. The outer coupling mechanism 346, however, is not restricted to any particular shape or size and may have a desired shape and size via which the plug deflector 302 can receive and otherwise couple the downhole tool.

The body 303 may further provide a deflector surface 310 at an intermediate location between the first and second ends 304*a,b*. Once the plug deflector 302 is properly secured within the main wellbore 114*a*, the deflector surface 310 may be used to deflect a downhole tool (not shown) into the lateral wellbore 114*b*. More particularly, after being received within the tool receptacle 306, the downhole tool may engage the deflector surface 310, which deflects the downhole tool into the lateral wellbore 114*b* via a window 312 defined in the body 303.

The body 303 may further include a plug 316 at or near the second end 304*b*. The plug 316 may be configured to extend into the main leg 210 and may include sealing elements 318 positioned at an interface between the plug 316 and the inner surface of the main leg 210 and provide a seal such that fluids (e.g., hydraulic fluids, wellbore fluids, gases, etc.) are unable to migrate across the sealing elements 318 in either direction. As will be appreciated, the sealing elements 318 may alternatively be carried within the main leg 210 and configured to sealingly engage the outer surface of the plug 316 as the plug 316 extends axially into the main leg 210.

The sealing elements 318 may be made of a variety of materials including, but not limited to, an elastomeric material, a metal, a composite, a rubber, a ceramic, any derivative thereof, and any combination thereof. In any example, the sealing elements 318 may comprise one or more O-rings or the like. In any example, however, the sealing elements 318 may comprise a set of v-rings or CHEVRON® packing rings, or another appropriate seal configuration (e.g., seals that are round, v-shaped, u-shaped, square, oval, t-shaped, rectangular with rounded corners, D-shaped profile, etc.), as generally known to those skilled in the art.

Figure 3B:
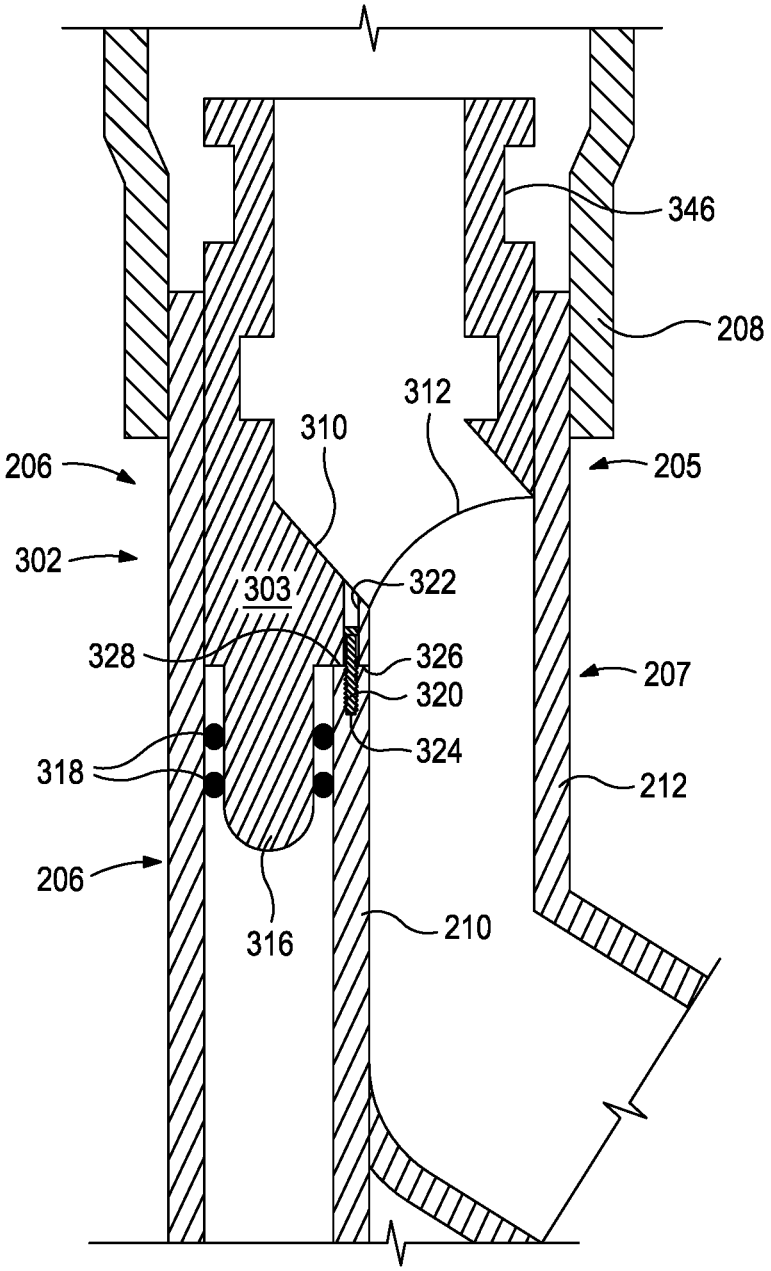
FIG. 3B illustrates an enlarged cross-sectional view of the plug deflector of FIG. 3A.

FIG. 3B illustrates an enlarged cross-sectional view of the plug deflector 302 installed in the Y-block 206. In any example, the plug deflector 302 may be secured to the Y-block 206 at the surface 106 and the entire assembly including both the Y-block 206 and the plug deflector 302 may be run downhole to be installed in the multi-lateral wellbore 114. As illustrated, the plug deflector 302 may define a no-go shoulder 326 configured to engage an opposing radial shoulder 328 provided by the main leg 210 of the Y-block 206. Engagement between the no-go shoulder 326 and the radial shoulder 328 ensures correct axial placement of the plug deflector 302 with respect to the Y-block 206.

In any example, as illustrated, the plug deflector 302 may be secured to the Y-block 206 using one or more mechanical fasteners 320 (one shown). As illustrated, the mechanical fastener 320 comprises a bolt or screw that can be extended into a through hole 322 defined in the plug deflector 302 and into a corresponding hole 324 defined within the main leg 210 to secure the plug deflector 302 to the Y-block 206. In any example, the mechanical fastener 320 may comprise a shear bolt or shear pin configured to fail upon assuming a predetermined axial load. As described below, this may prove advantageous in allowing the plug deflector 302 to be detached from the Y-block 206 following down hole operations.

Figure 3C:
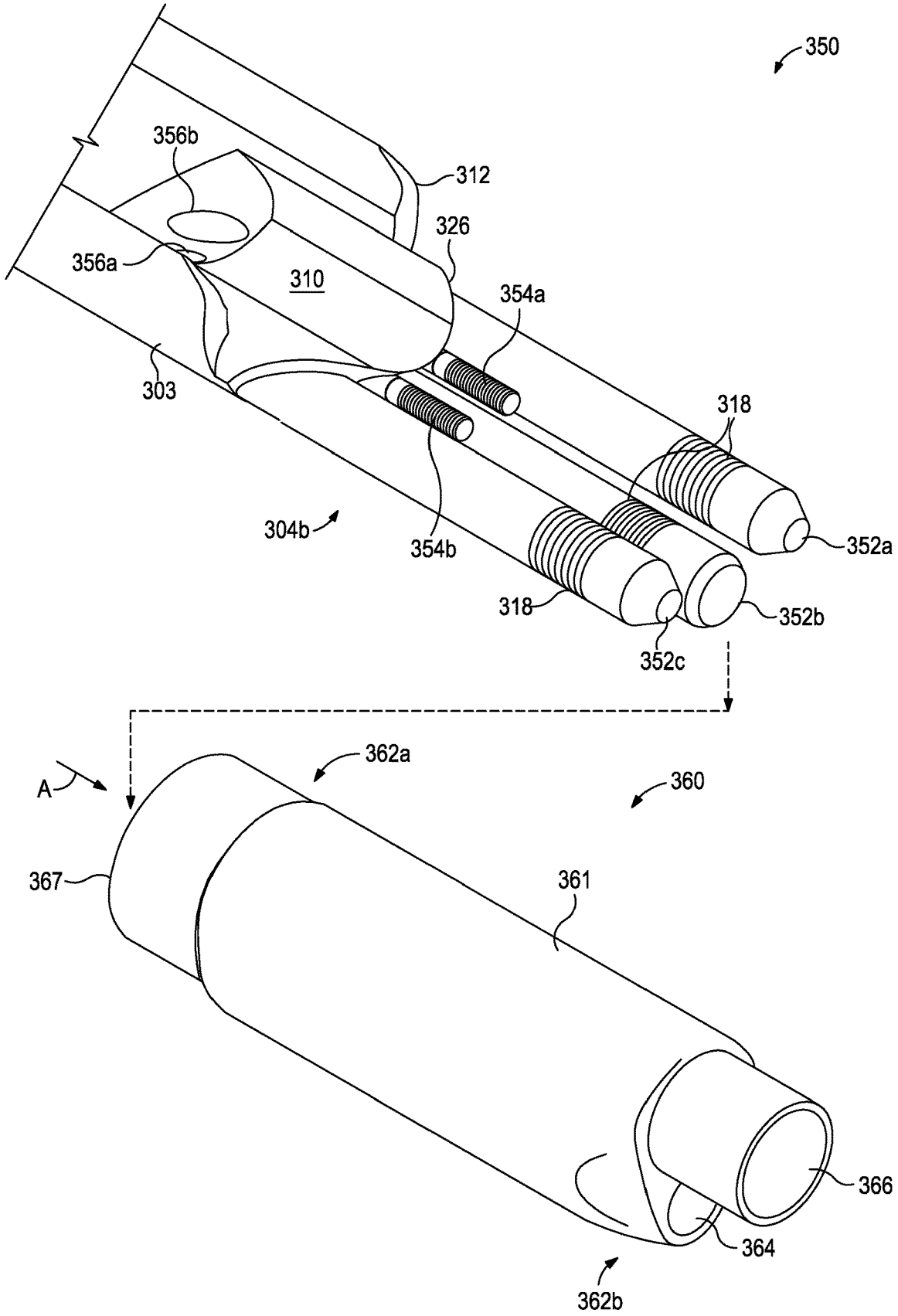
FIG. 3C illustrates isometric views of the second end of another exemplary plug deflector and a Y-block used therewith.

FIG. 3C illustrates isometric views of the second end 304*b* of another exemplary plug deflector 350 and a Y-block 360. The plug deflector 350 may be similar in some respects to the plug deflector 302 of FIGS. 3A and 3B, and therefore may be best understood with reference thereto where like numerals designate like components not described again in detail. As illustrated, the body 303 of the plug deflector 350 may include three plugs 352*a*, 352*b*, and 352*c* at or adjacent the second end 304*b*. It should be noted that the number of plugs 352*a,b,c* in FIG. 3C is an example and may increase or decrease, without departing from the scope of the disclosure. Also, the plugs 352*a,b,c* are not restricted to any particular shape or size, but may rather exhibit any desired shape and size via which the plugs 352*a,b,c* can prevent fluid flow when installed in the Y-block 360.

The plug deflector 350 may define through holes 356*a* and 356*b* each for receiving a mechanical fastener 354*a* and 354*b*. The mechanical fasteners 354*a* and 354*b* secure the plug deflector 350 in a Y-block (described below). In any example, the mechanical fasteners 354*a,b* comprise shear bolts or shear pins configured to fail upon assuming a predetermined axial load. Due to the presence of two mechanical fasteners 354*a* and 354*b*, an increased amount of axial load (or shear force) may be required to fail the mechanical fasteners 354*a* and 354*b*. It should be noted that the number of mechanical fasteners 354*a,b* (and the corresponding through holes 356*a,b*) illustrated in FIG. 3C is merely one example and may increase or decrease, without departing from the scope of the disclosure.

The Y-block 360 may have an elongated body 361 having a first end 362*a* and a second end 362*b* opposite the first end 362*a*. The Y-block 360 defines a main leg 364 and a lateral leg 366, each extending axially between the first end 362*a* and the second end 362*b*. At or adjacent the first end 362*a*, the main leg 364 and the lateral leg 366 are each in fluid communication with an opening 367 defined in the body 361. Although not explicitly illustrated, a main completion string installed in a main wellbore (e.g., the main wellbore 114*a*, FIG. 1) may be mechanically and fluidly coupled to the main leg 364 at or adjacent the second end 362*b*. Similarly, a lateral completion string installed in a lateral wellbore (e.g., the lateral wellbore 114*b*, FIG. 1) may be mechanically and fluidly coupled to the lateral leg 366 at or adjacent the second end 362*b*.

Figure 3D:
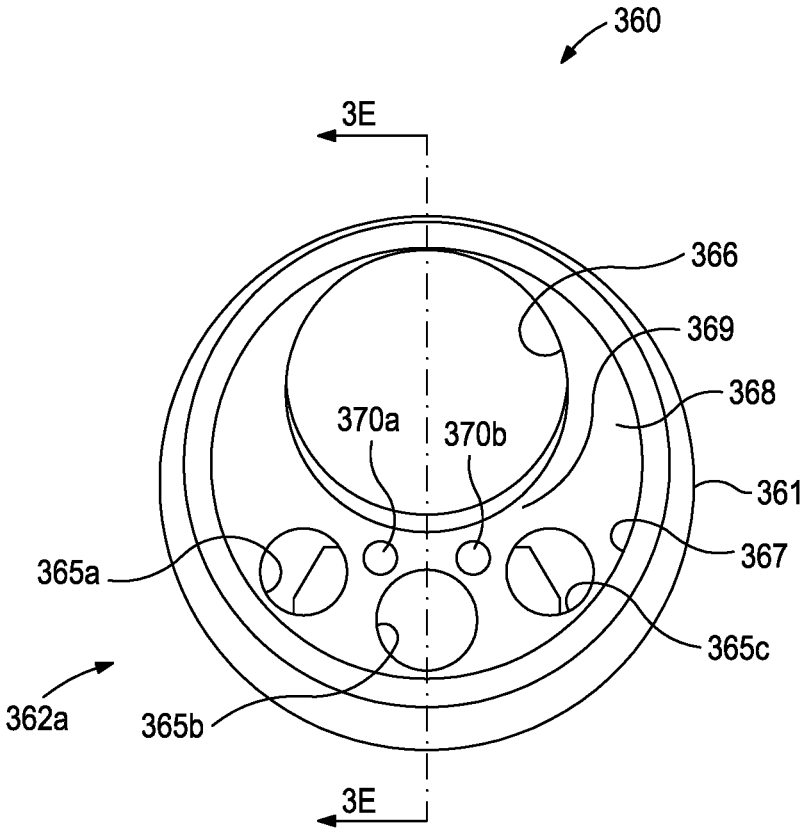
FIG. 3D illustrates a plan view of the first end of the Y-block of FIG. 3C as viewed in the direction indicated by the arrow A of FIG. 3C.
Figure 3E:
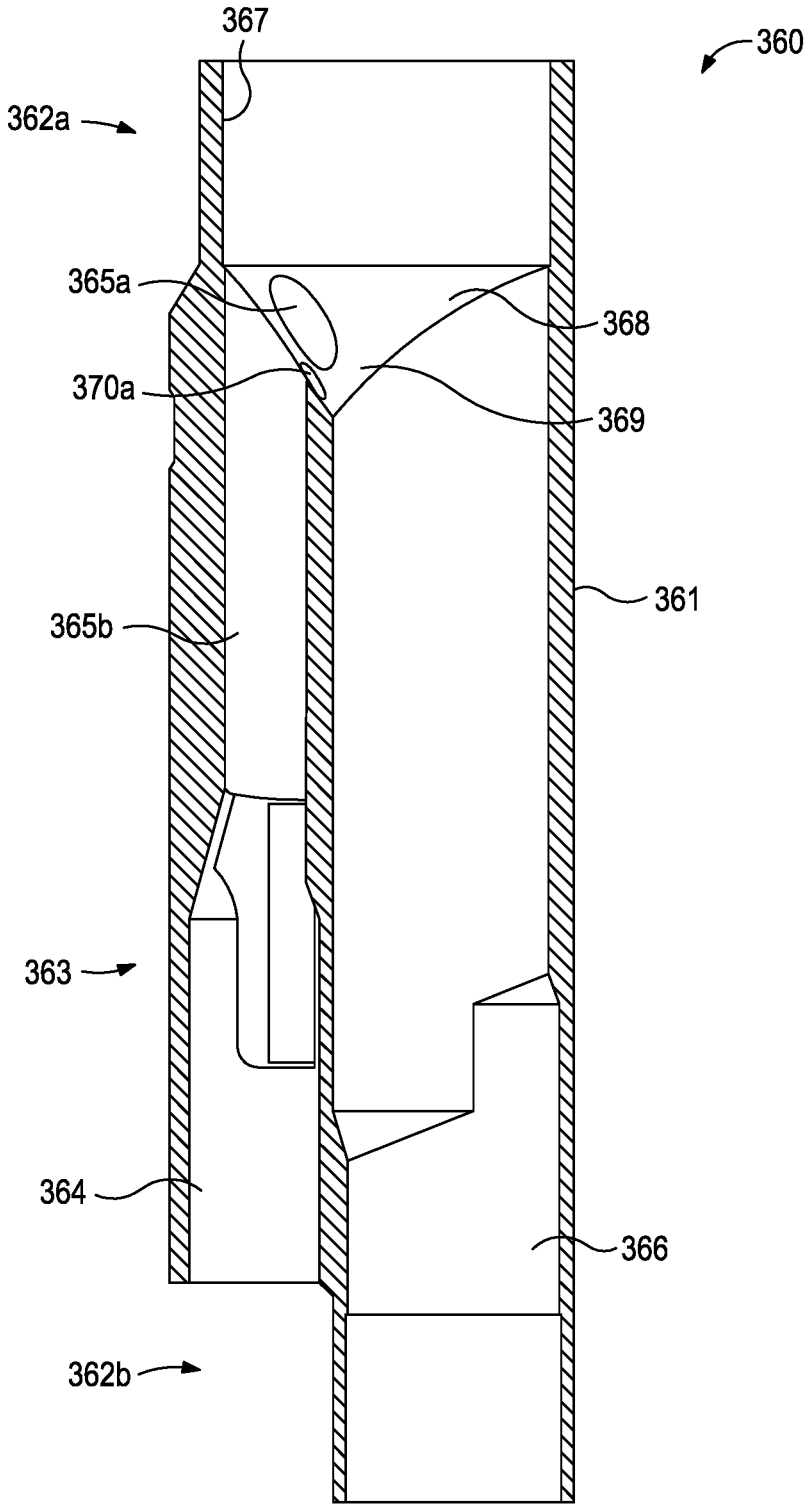
FIG. 3E illustrates a cross-section view of the Y-block of FIG. 3D taken along the line 3E-3E.

FIG. 3D illustrates an end view of the Y-block 360 as viewed toward the first end 362*a* in the direction indicated by the arrow A of FIG. 3C. FIG. 3E illustrates a cross-section view of the Y-block 360 taken along the line 3E-3E in FIG. 3D. As shown in FIGS. 3D and 3E, the body 361 of the Y-block 360 may also provide a deflector surface 368 adjacent the first end 362*a*. The main leg 364 further defines three individual flow paths 365*a*, 365*b*, and 365*c* each originating from the deflector surface 368 and extending axially therefrom. The flow paths 365*a,b,c* fluidly couple with each other at a common location 363 adjacent the second end 362*b*. The lateral leg 366 also extends axially from the deflector surface 368 to the second end 362*b*. The body 361 may also define two holes 370*a* and 370*b* (FIG. 3D) located adjacent the flow paths 365*a,b,c* and extending axially a desired distance from the deflector surface 368.

Figure 3F:
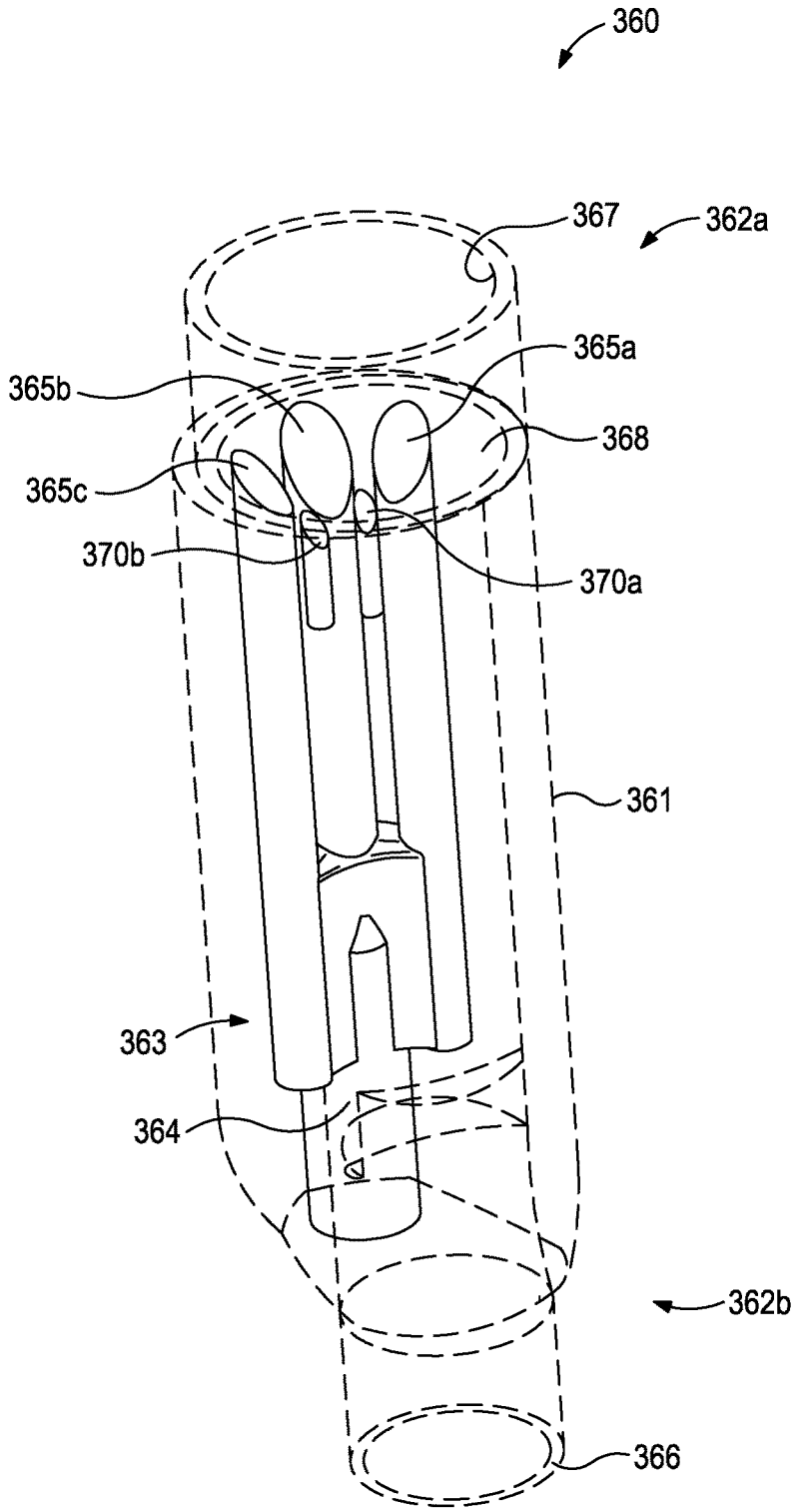
FIG. 3F illustrates an isometric view of the flow paths defined in the main leg of the Y-block of FIGS. 3D-3E.

Referring briefly to FIG. 3F, illustrated is an isometric view of flow paths 365*a*, 365*b*, and 365*c* defined in the main leg 364 and the holes 370*a* and 370*b*. For the sake of clarity, the body 361 and the remaining features of the Y-block 360 are illustrated in phantom.

Referring back to FIGS. 3C-3E, when the plug deflector 350 is installed in the Y-block 360, the plugs 352*a,b,c* are received in the respective flow paths 365*a,b,c* and the mechanical fasteners 354*a,b* are received in the respective holes 370*a,b*. The no-go shoulder 326 of the plug deflector 350 may engage an opposing radial shoulder 369 provided by the main leg 364 and thereby prevent axial movement of the plug deflector 350 and ensure correct placement of the plug deflector 350 in the Y-block 360. The sealing elements 318 on each plug 352*a,b,c* engage the inner surface of the respective flow paths 365*a,b,c* to provide a sealed engagement. As will be appreciated, the sealing elements 318 may alternatively be carried within the flow paths 365*a,b,c* and configured to sealingly engage the outer surface of the plugs 352*a,b,c* as the plugs 352*a,b,c* extend axially into the flow paths 365*a,b,c*. It should be noted that the openings of the flow paths 365*a,b,c* and the holes 370*a,b* on the deflector surface 368 are sized such that they permit a downhole tool to deflect off the deflector surface 368 and enter the lateral leg 366. In any example, the openings of the flow paths 365*a,b,c* and the holes 370*a,b* may be sized smaller than a leading end of the downhole tool so that the downhole tool does not get stuck in the openings of the flow paths 365*a,b,c* and the holes 370*a,b*.

Figure 4A:
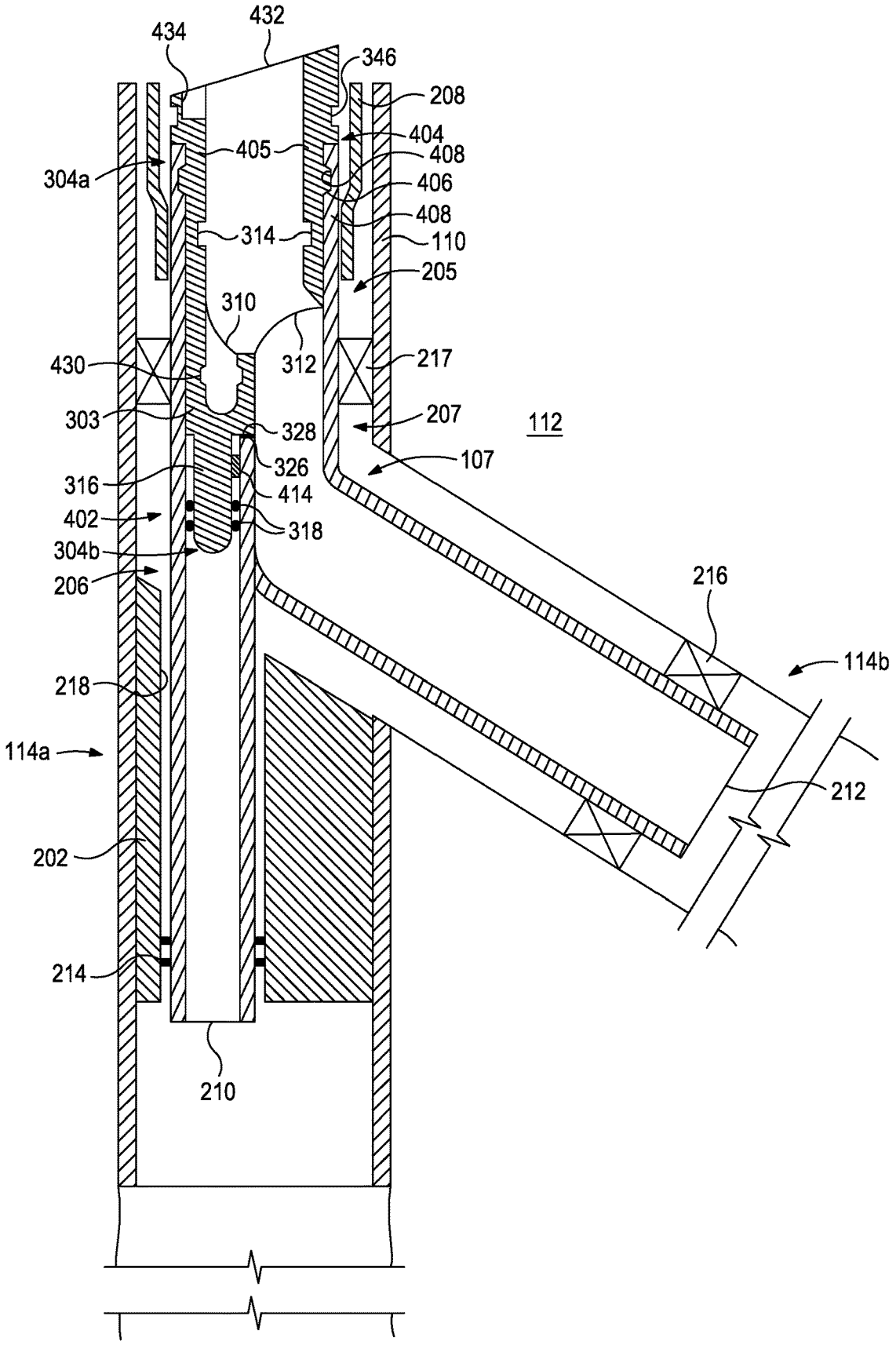
FIG. 4A illustrates another plug deflector installed in the Y-block of FIG. 2.

FIG. 4A illustrates another exemplary plug deflector 402 that may be installed in the Y-block 206. The plug deflector 402 may be similar in some respects to the plug deflector 302 of FIGS. 3A and 3B, and therefore may be best understood with reference thereto where like numerals designate like components not described again in detail. Unlike the plug deflector 302 of FIGS. 3A and 3B, the plug deflector 402 may include a coupling device 404 used to couple the plug deflector 402 to the Y-block 206.

In any example, the coupling device 404 comprises a collet device arranged at or adjacent the first end 304*a* of the body 303. As a result, the coupling mechanism 314 may be re-positioned downhole from the coupling device 404. As illustrated, the coupling device 404 may include a plurality of axially extending fingers 405, each having a radial projection 406 defined thereon and used to locate a corresponding collet profile 408 defined on an inner radial surface of the Y-block 206. Additionally or alternatively, in any example, the coupling device 404 may comprise a lock mandrel.

A second coupling mechanism 430 may be defined in the body 303 of the plug deflector 402 and may be used to receive and otherwise couple a downhole tool (e.g., a retrieving tool) to the plug deflector 402. The second coupling mechanism 430 may be used in addition or as an alternative to the coupling mechanism 314. As illustrated, the second coupling mechanism 430 may comprise a blind hole that extends axially a desired depth into the body 303 of the plug deflector 402 from the deflector surface 310. The blind hole may be profiled such that a downhole tool can locate and couple to the plug deflector 402 via the blind hole to install and/or remove the plug deflector 402 from the Y-block 206. It should be noted that the second coupling mechanism 430 is not restricted to any particular shape or size and may have a desired shape and size via which the plug deflector 402 can be installed and/or removed from the Y-block 206. The second coupling mechanism 430, however, may be sized such that a downhole tool intended for the lateral wellbore 114*b* is unable to locate the second coupling mechanism 430. In order to ensure that a downhole tool is correctly oriented to engage the second coupling mechanism 430, the plug deflector 402 may define a tapering uphole surface 432 at an uphole end thereof and a longitudinal groove 434 extending axially a desired distance from the tapering uphole surface 432.

Figure 4B:
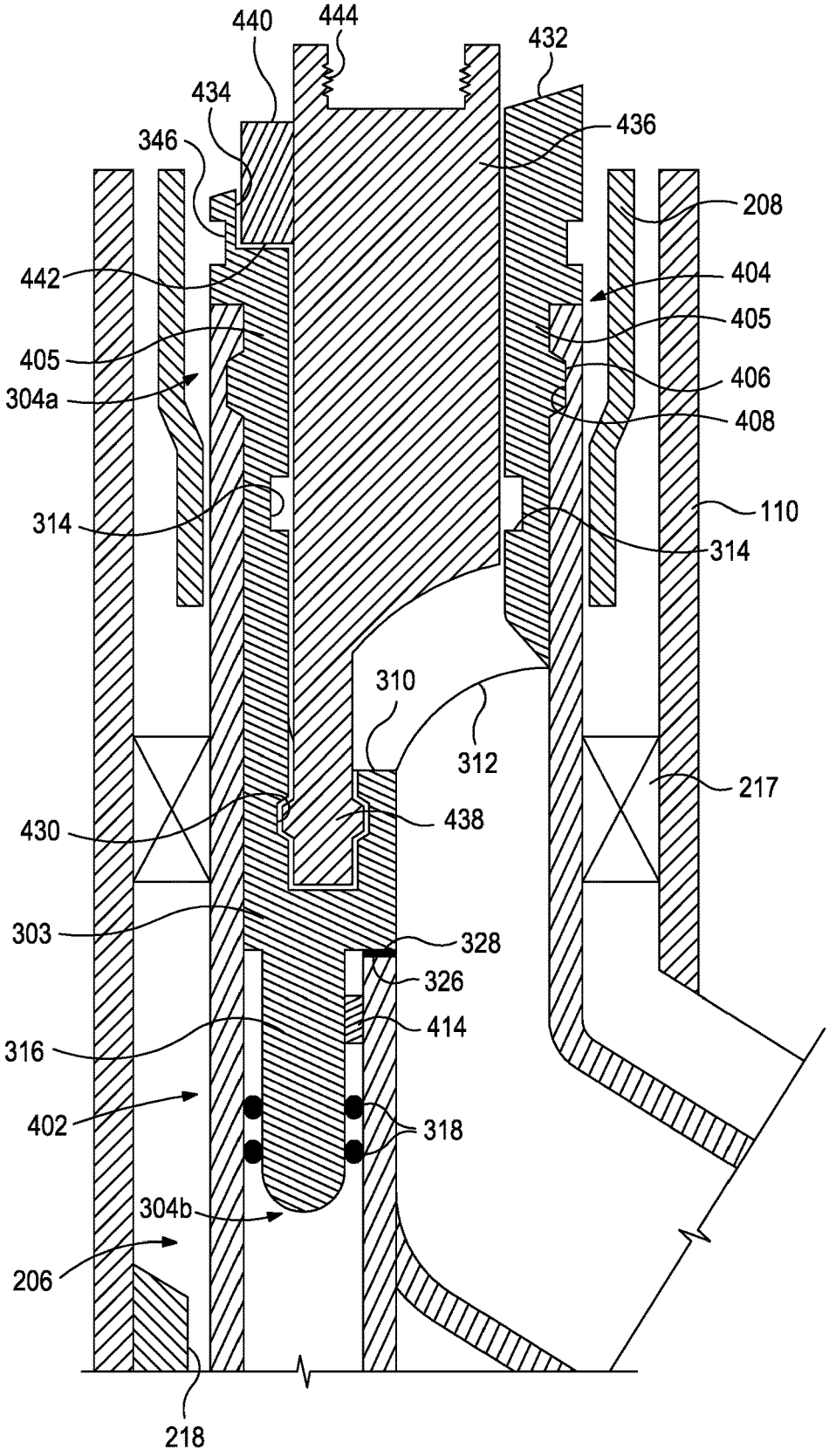
FIG. 4B illustrates an enlarged cross-sectional view of the plug deflector of FIG. 4A.

FIG. 4B illustrates an enlarged cross-sectional view of the plug deflector 402 and a downhole tool (e.g., a retrieving tool) 436 engaging the second coupling mechanism 430 of the plug deflector 402. As illustrated, the downhole tool 436 may include an engagement mechanism 438 configured to engage and otherwise couple to the second coupling mechanism 430. In an example, the engagement mechanism 438 may have spring-loaded keys or lugs that correspond to the profile of the second coupling mechanism 430.

An orienting key 440 may be positioned or otherwise defined on an outer surface of the downhole tool 436. The orienting key 440 may define a leading edge 442 configured to locate and slidingly engage the tapering uphole surface 432. When the orienting key 440 locates and engages the plug deflector 402, the leading edge 442 of the orienting key 440 slides against the tapering uphole surface 432 and thereby angularly orients the downhole tool 436 to a predetermined angular orientation. Once the orienting key 440 locates and enters the longitudinal groove 434, the downhole tool 436 will be oriented in the correct angular orientation in the plug deflector 402. The downhole tool 436 may include or otherwise define a connector 444 at an uphole end thereof. As illustrated, the connector 444 may be a threaded hole. The downhole tool 436 may be coupled to a conveyance, such as a wireline, coiled tubing, or the like, via the connector 444 to convey the downhole tool 436 in the wellbore 114 (FIG. 1).

Although the second coupling mechanism 430 has been described above with respect to the plug defector 402, it will be understood by one of skill in the art that the second coupling mechanism 430 may also be included in the plug deflector 302 in FIGS. 3A-3B, without departing from the scope of the disclosure. For instance, the second coupling mechanism 430 may be disposed on the deflector surface 310 uphole from the through hole 322. Further, the plug deflector 402 may also define the tapering uphole surface 432 and the longitudinal groove 434 for guiding and orienting a downhole tool for installing and/or removing the plug deflector 402 from the Y-block 206.

The plug 316 may further include an orienting key 414 positioned on an outer radial surface of the plug 316 and uphole from the sealing elements 318. The orienting key 414 may help angularly orient the plug deflector 402 with respect to the Y-block 206 while installing the plug deflector 402. In any example, the orienting key 414 may be spring-loaded.

Figure 4C:
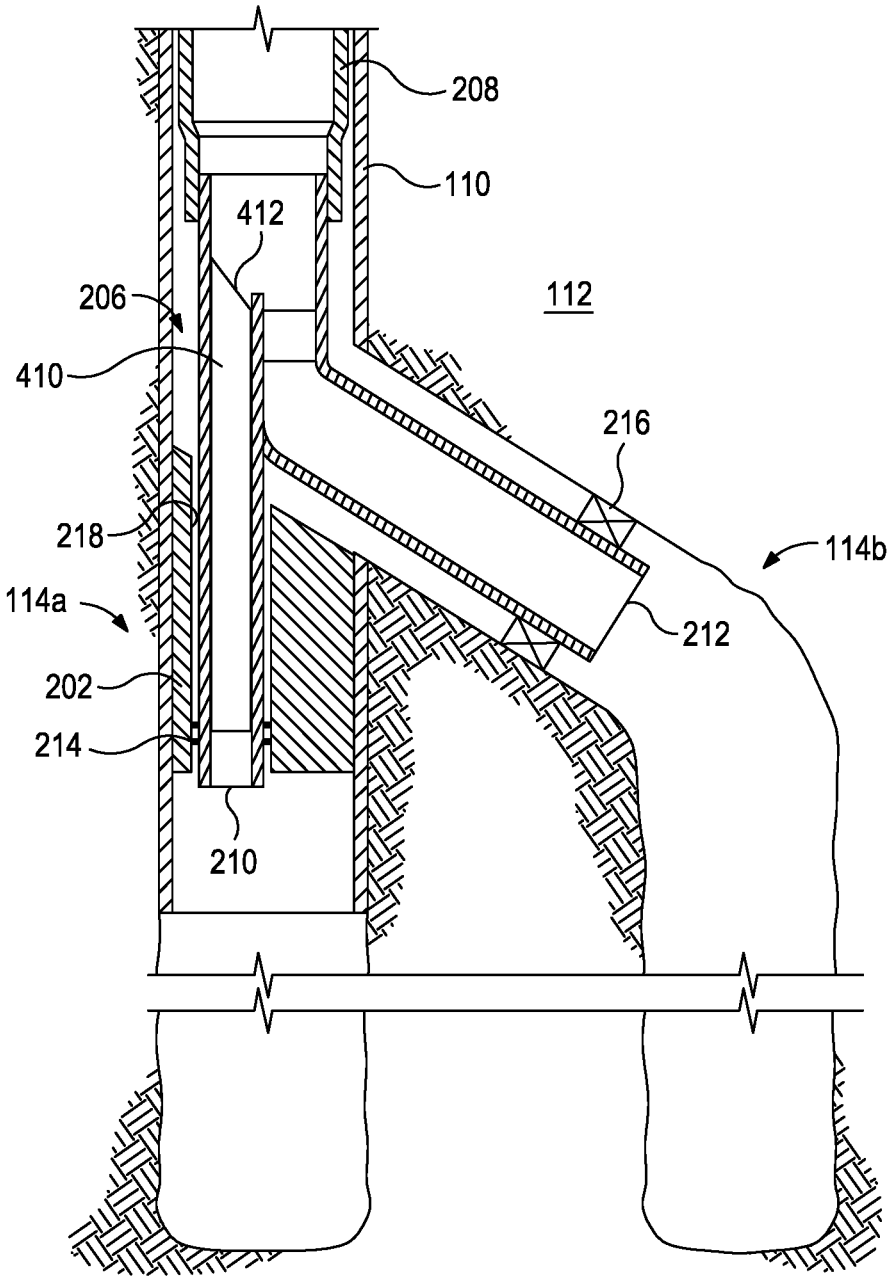
FIG. 4C illustrates a muleshoe installed within the main leg of the Y-block of FIG. 2.

FIG. 4C illustrates a cross-sectional view of the Y-block 206 including a muleshoe 410. The muleshoe 410 may be installed and/or otherwise included within the main leg 210 of the Y-block 206 to help angularly orient the plug deflector 402 with respect to the Y-block 206. Alternatively, in any example, the muleshoe 410 may be installed or otherwise included in the internal passage 201 (FIG. 2) defined in the single passage section 205 (FIG. 2) of the Y-block 206. However, the location of the muleshoe 410 is not restricted to any particular location and the muleshoe 410 may be installed or positioned at any desired location in the Y-block or the multi-lateral wellbore 114 to help angularly orient the plug deflector 402 with respect to the Y-block 206. For the sake of clarity of illustration, the muleshoe 410 is not shown in FIG. 4A and the plug deflector 402 is not shown in FIG. 4C.

Figure 4D:
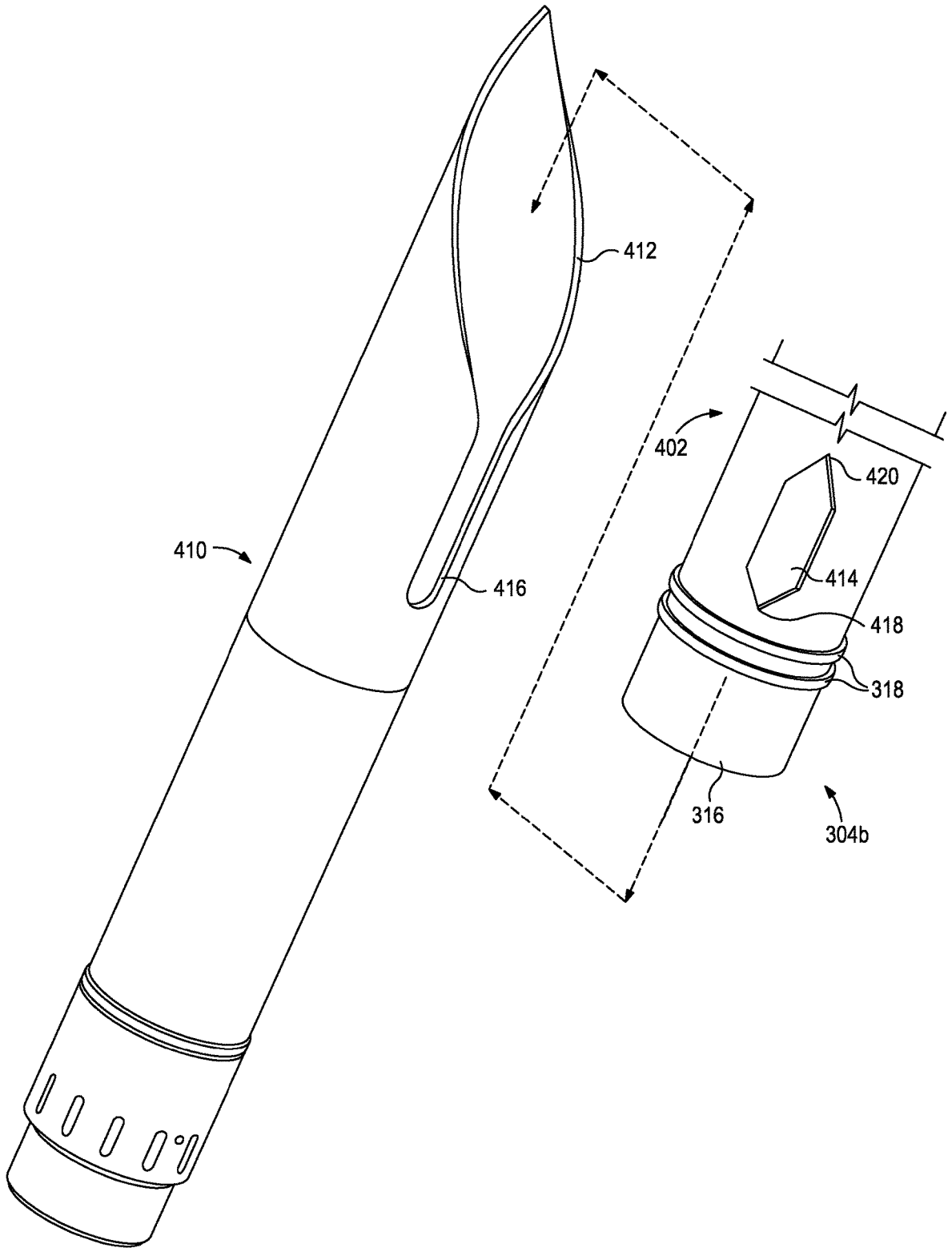
FIG. 4D illustrates an exploded isometric view of the muleshoe of FIG. 4C and the second end of the plug deflector of FIG. 4A.
Figure 4E:
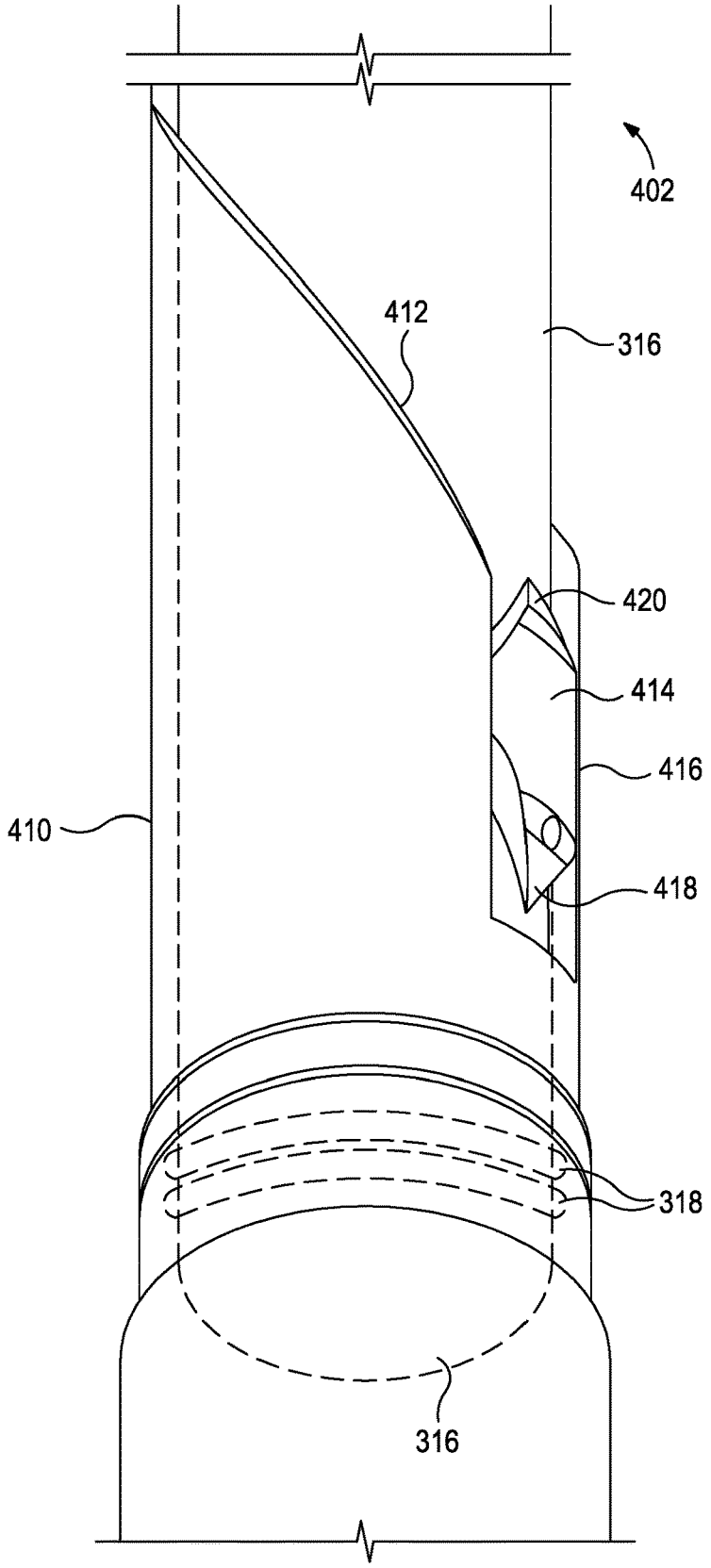
FIG. 4E illustrates an isometric view of the muleshoe of FIG. 4C with the plug deflector of FIG. 4A installed therein.

FIG. 4D illustrates an exploded isometric view of the muleshoe 410 and the second end 304*b* of the plug deflector 402, and FIG. 4E illustrates an isometric view of the muleshoe 410 with the plug deflector 402 received therein. The muleshoe 410 may define a tapering uphole surface 412 and a longitudinal groove 416 extending axially from the tapering uphole surface 412. The orienting key 414 may define a tapered (angled) leading edge 418 configured to locate and slidingly engage the tapering uphole surface 412. In any example, the orienting key 414 may also define a tapered trailing edge 420 located opposite the tapered leading edge 418.

When the orienting key 414 locates and engages the muleshoe 410, the tapered leading edge 418 of the orienting key 414 slides against the tapering uphole surface 412 and thereby angularly orients the plug deflector 402 to a predetermined angular orientation. Once the orienting key 414 locates and enters the groove 416, the plug deflector 402 will be oriented in the correct angular orientation in the Y-block 206. Although examples above describe using the muleshoe 410 to correctly orient the plug deflector 402 in the Y-block 206, any other mechanical device, electronic device, electrical device, hydraulic device, or a combination thereof may be used. In any example, when a plug deflector 402 engages the Y-block 206, one or more sensors installed on the plug deflector 402 determine the angular orientation of the deflector surface 310 and, using an integrated electric motor, rotates the plug deflector 402 to the desired orientation. Alternatively, in other examples, one or more sensors may be installed uphole from the Y-block 206 and may help angularly orient the plug deflector 402 with respect to the Y-block 206 prior to the plug deflector 402 engaging the Y-block 206.

Figure 5A:
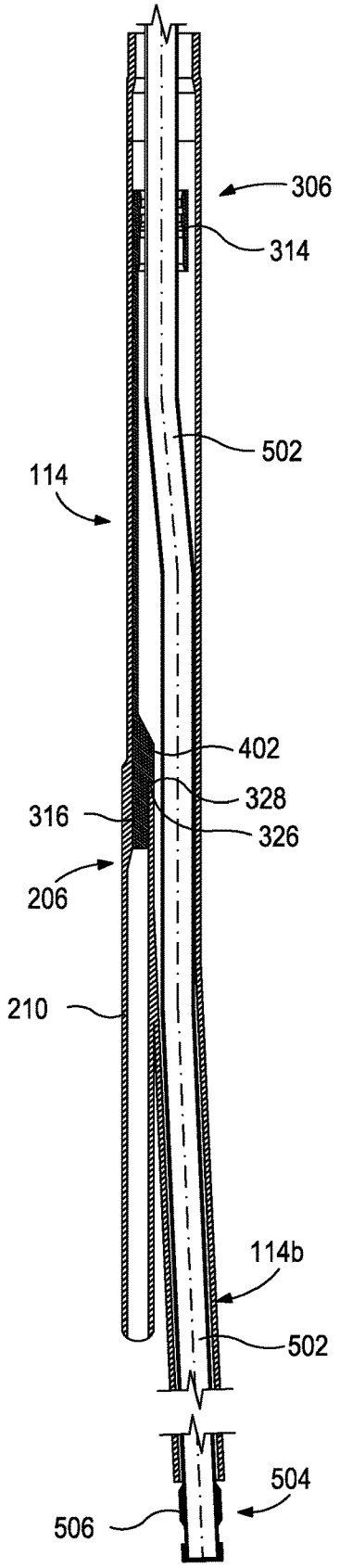
FIGS. 5A-5C schematically illustrate progressive views of removing the plug deflector of FIG. 4A from the Y-block of FIG. 2.
Figure 5B:
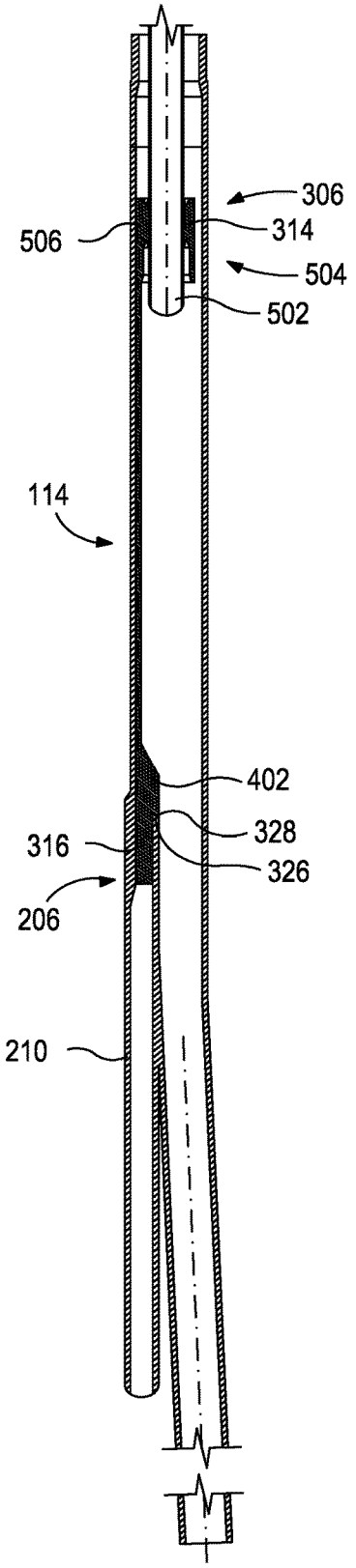
Figure 5C:
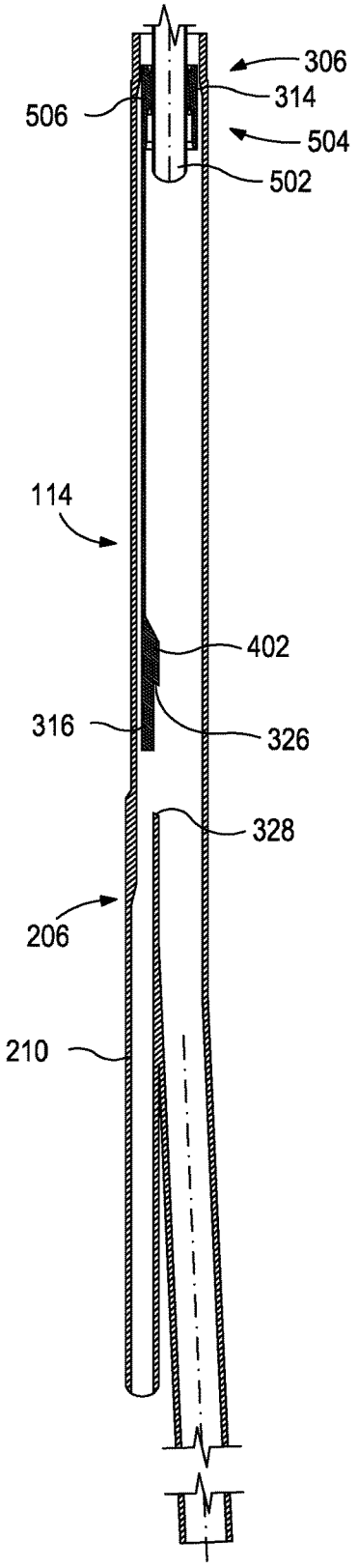

FIGS. 5A-5C schematically illustrate progressive cross-sectional side views of removing the plug deflector 402 of FIGS. 4A-4E from within the Y-block 206. As illustrated in FIG. 5A, the plug deflector 402 is installed in the main leg 210 of the Y-block 206, and a tool string 502 is extended within the lateral wellbore 114*b* for performing one or more wellbore operations. The wellbore operations may include, but are not limited to, wellbore stimulation, retrieving lost tools, wellbore completion, well logging, or any desired wellbore operations. The tool string 502 may include a retrieving tool 504 positioned at the lower distal end of the tool string 502. Alternatively, the retrieving tool 504 may be placed at any point along the axial length of the tool string 502. The retrieving tool 504 may include an engagement mechanism 506 configured to engage and otherwise couple to the coupling mechanism 314. In any example where the coupling mechanism 314 comprises a collet device or an annular groove or profile, the engagement mechanism 506 may have spring-loaded keys or lugs that correspond to the collet device or the annular groove or profile.

After the wellbore operations are completed, the tool string 502 is pulled uphole until the engagement mechanism 506 locates and engages the plug deflector 402, as illustrated in FIG. 5B. Once properly engaged, the tool string 502 is pulled uphole to exert an axial load on the coupling device 404. Once a predetermined axial load is assumed by the coupling device 404, the radial projections 406 (FIG. 4A) are dislodged from the collet profile 408 (FIG. 4A) and the plug deflector 402 is released from the Y-block 206. As shown in FIG. 5C, the plug deflector 402 may then be retrieved uphole using the tool string 502.

The above removal operation may be performed in reverse to couple the plug deflector 402 to the Y-block 206. More particularly, the plug deflector 402 may be conveyed into the wellbore 114 as coupled to the tool string 502 at the engagement mechanism 506, as described above. As the tool string 502 advances downhole, the plug 316 of the plug deflector 402 extends axially into the main leg 210. In any example where the orienting key 414 (FIGS. 4A-4E) is employed, the orientating key 414 may locate and slide against the tapering uphole surface 412 (FIGS. 4D and 4E) of the muleshoe 410 (FIGS. 4D and 4E) to angularly orient the plug deflector 402 to the predetermined angular orientation. The orienting key 414 may subsequently enter the groove 416 (FIG. 4D), thereby placing the plug deflector 402 in the correct angular orientation in the Y-block 206. Further axial movement of the plug deflector 402 will allow the no-go shoulder 326 to eventually locate and engage the opposing radial shoulder 328 of the main leg 210, which stops the axial movement of the plug deflector 402 and ensures the correct axial placement of the plug deflector 402 in the Y-block 206. Stopping axial movement of the plug deflector 402 as engaged against the Y-block 206 places an axial load on the engagement mechanism 506. Once a predetermined axial load is assumed by the engagement mechanism 506, the engagement mechanism 506 detaches from the plug deflector 402 and the tool string 502 can then be advanced further downhole. The tool string 502 contacts the deflector surface 310 (FIG. 4A) and is deflected into the lateral wellbore 114*b*.

The removal operation may similarly be used to remove the plug deflector 302 of FIGS. 3A-3B from the Y-block 206 and the plug deflector 350 of FIG. 3C from the Y-block 360 that have been coupled thereto using a shear bolt or shear pin configured to fail upon assuming a predetermined axial load. Accordingly, when the tool string 502 exerts the predetermined axial load, the plug deflectors 302, 350 are released from the corresponding Y-blocks 206, 360 and can be retrieved to the surface 106 (FIG. 1).

In any example, the plug deflectors 302, 350 may be single-use devices and, therefore, cannot be reinstalled in the corresponding Y-blocks 206, 360 while the Y-blocks 206, 360 are in the wellbore 114 (FIG. 1). In any example, reinstalling the plug deflectors 302, 350 in the corresponding Y-blocks 206, 360 may require the Y-blocks 206, 360 to be removed from the wellbore 114 and retrieved to the surface 106. The plug deflectors 302, 350 can then be reinstalled on the well surface 106 (FIG. 1). In any example, however, the plug deflector 402 may be reinstalled within the Y-block 206 while the Y-block 206 is installed in the wellbore 114. Alternatively, in any example, the plug deflectors 302, 350, and 402 described above, and the plug deflectors 602 and 650 described below, can be installed in the corresponding Y-blocks at the well surface 106. The combination including the plug deflector and Y-block can then be installed in the wellbore 114. Because the plug deflector and Y-block are run downhole on the same trip, the number of trips may be reduced resulting in substantial time and cost savings. In examples, separate tool strings may be used to install the plug deflectors 302, 350, and 402 (described above), and the plug deflectors 602 and 650 (described below), and the conduct wellbore operations. More particularly, a first tool string (e.g., a tool string having the engagement mechanism 506 for engaging the plug deflector) may be used to install the plug defectors in the corresponding Y-blocks. After installing the plug deflector, the first tool string is retrieved to the surface 106 (FIG. 1). A second tool string may then be conveyed into the lateral wellbore 114*b* to perform wellbore operations. After the wellbore operations are completed, the second tool string is pulled uphole and engages the plug deflector. The second tool string may include an engagement mechanism that may engage the plug deflector only when the tool string travels uphole. The plug deflector is retrieved to the surface 106 using the second tool string, as described above. Alternatively, the second tool string may be retrieved to the surface 106 without the plug deflector, and the first tool string (or any other tool string configured to engage the plug deflector) is reintroduced into the multi-lateral wellbore 114 to engage the plug deflector. The plug deflector is retrieved to the surface 106 using the first tool string, as described above.

Figure 6A:
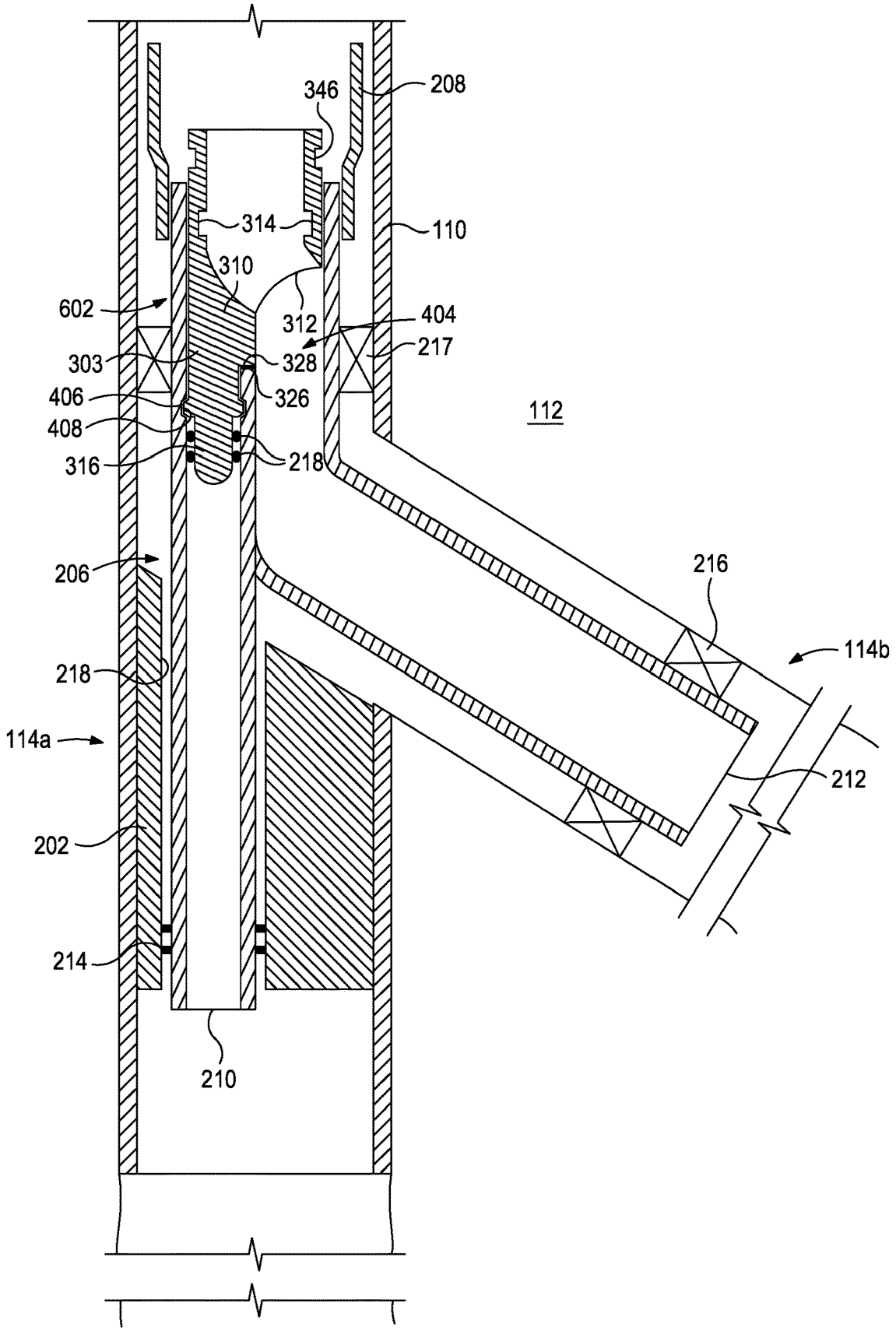
FIG. 6A illustrates yet another plug deflector installed in the Y-block of FIG. 2.

FIG. 6A illustrates another exemplary plug deflector 602. The plug deflector 602 may be similar in some respects to the plug deflector 402 of FIGS. 4A-4B and therefore may be best understood with reference thereto, where like numerals designate like components not described again in detail. Similar to the plug deflector 402 of FIGS. 4A-4B, the plug deflector 602 may include the coupling device 404, but the coupling device 404 may be located at or near the second end 304*b* of the body 303. In any example, the coupling device 404 may be located on the plug 316 of the plug deflector 602. As illustrated, the collet profile 408 may be defined in the inner surface of the main leg 210 of the Y-block 206.

When the plug deflector 602 is installed, the projections 406 of the coupling device 404 may be received in the collet profile 408. The plug deflector 602 may be removed using the operations illustrated in FIGS. 5A-5C above. Although not expressly illustrated, in order to ensure correct placement of the plug deflector 602 in the Y-block 206, a muleshoe, for example, similar to the muleshoe 410 in FIGS. 4B-4E may be installed in the Y-block 206 and an orienting key, for example, similar to the orienting key 414 in FIGS. 4D-4E may be included on the plug deflector 602. Additionally or alternatively, as described above, any mechanical device, electronic device, electrical device, hydraulic device, or a combination thereof may be used to orient the plug deflector 602 in the Y-block 206.

Figure 6B:
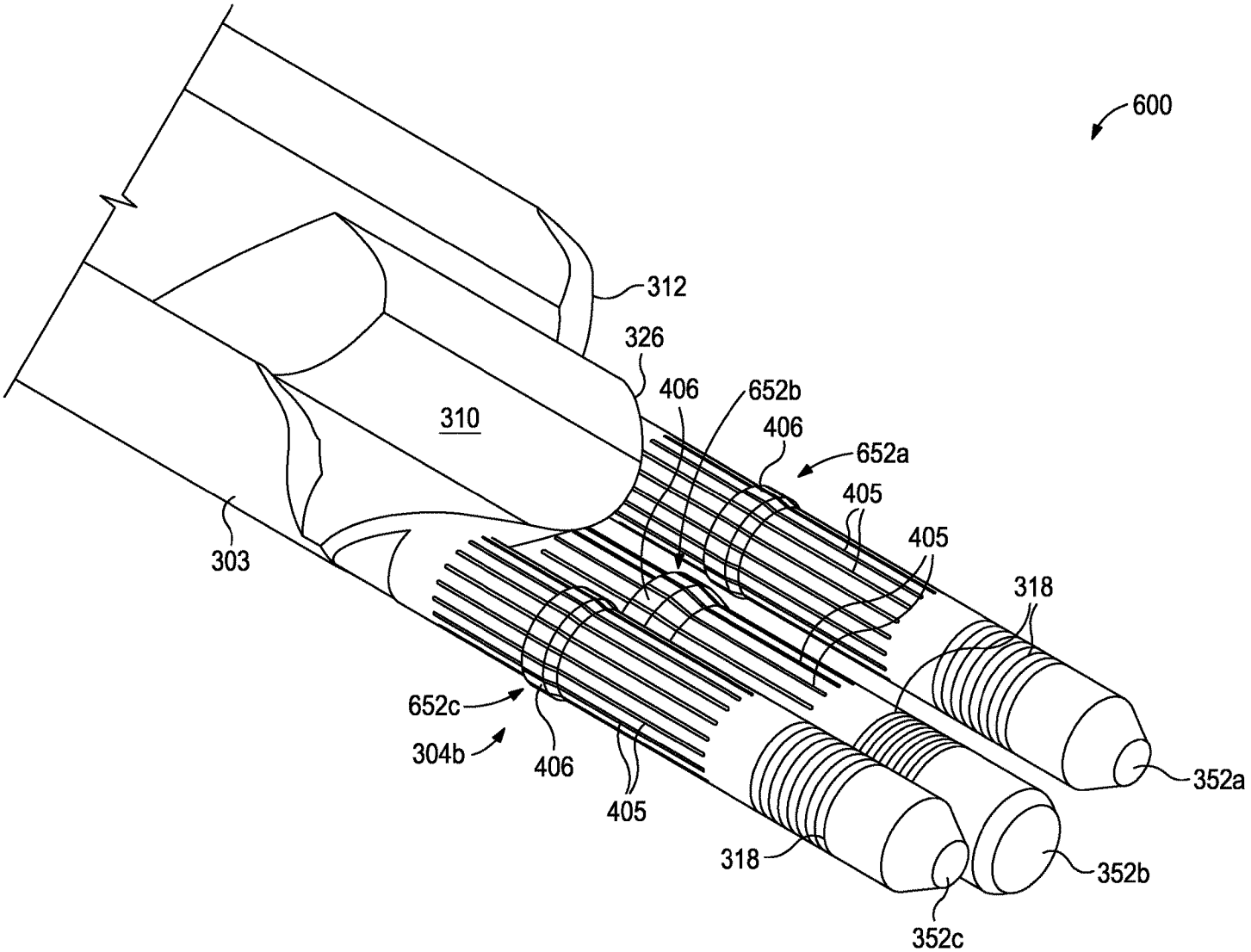
FIG. 6B illustrates an isometric view of the second end of another exemplary plug deflector.

FIG. 6B illustrates an isometric view of the second end 304*b* of another exemplary plug deflector 650. The plug deflector 650 may be similar in some respects to the plug deflector 350 of FIG. 3C and the plug deflector 602 of FIG. 6A and therefore may be best understood with reference thereto, where like numerals designate like components not described again in detail. As illustrated, the plug deflector 650 may include the three plugs 352*a,b,c* including respective coupling devices 652*a,b,c* (each similar to coupling device 404). As illustrated, the coupling devices 652*a,b,c* each comprise a collet device. The coupling devices 652*a, b,c* may each include a plurality of axially extending fingers 405, each having a radial projection 406 defined thereon.

The plug deflector 650 may be installed in a Y-block similar to the Y-block 360 illustrated in FIGS. 3C-3E. In such a Y-block 360, a corresponding collet profile is defined on an inner radial surface of each flow path 365*a,b,c* (FIG. 3D). When the plug deflector 350 is installed, the projections 406 of the coupling devices 652*a,b,c* may be received in the respective collet profiles defined in the Y-block.

Although not expressly illustrated, it will be understood by one skilled in the art that the plug deflectors 602 and 650 may each include the second coupling mechanism 430 depicted in FIGS. 4A and 4B, without departing from the scope of the disclosure. Further, each plug deflector 602 and 650 may also define the tapering uphole surface 432 and the longitudinal groove 434 for guiding and orienting a downhole tool for installing and/or removing the plug deflectors 602 and 650 from the corresponding Y-blocks.

During operation, a pressure differential may be generated across the sealing elements 318 (FIG. 3A-3C, 4A, 4B, 6A). As a result, installing and/or removing the plug deflectors 302, 350, 402, 602, and/or 650 following operation may be difficult. In any example, however, one or more of the plug deflectors 302, 350, 402, 602, and/or 650 may be configured to equalize the pressure differential so that the plug deflectors 302, 350, 402, 602, and/or 650 may be removed from the corresponding Y-blocks with relative ease.

Figure 7A:
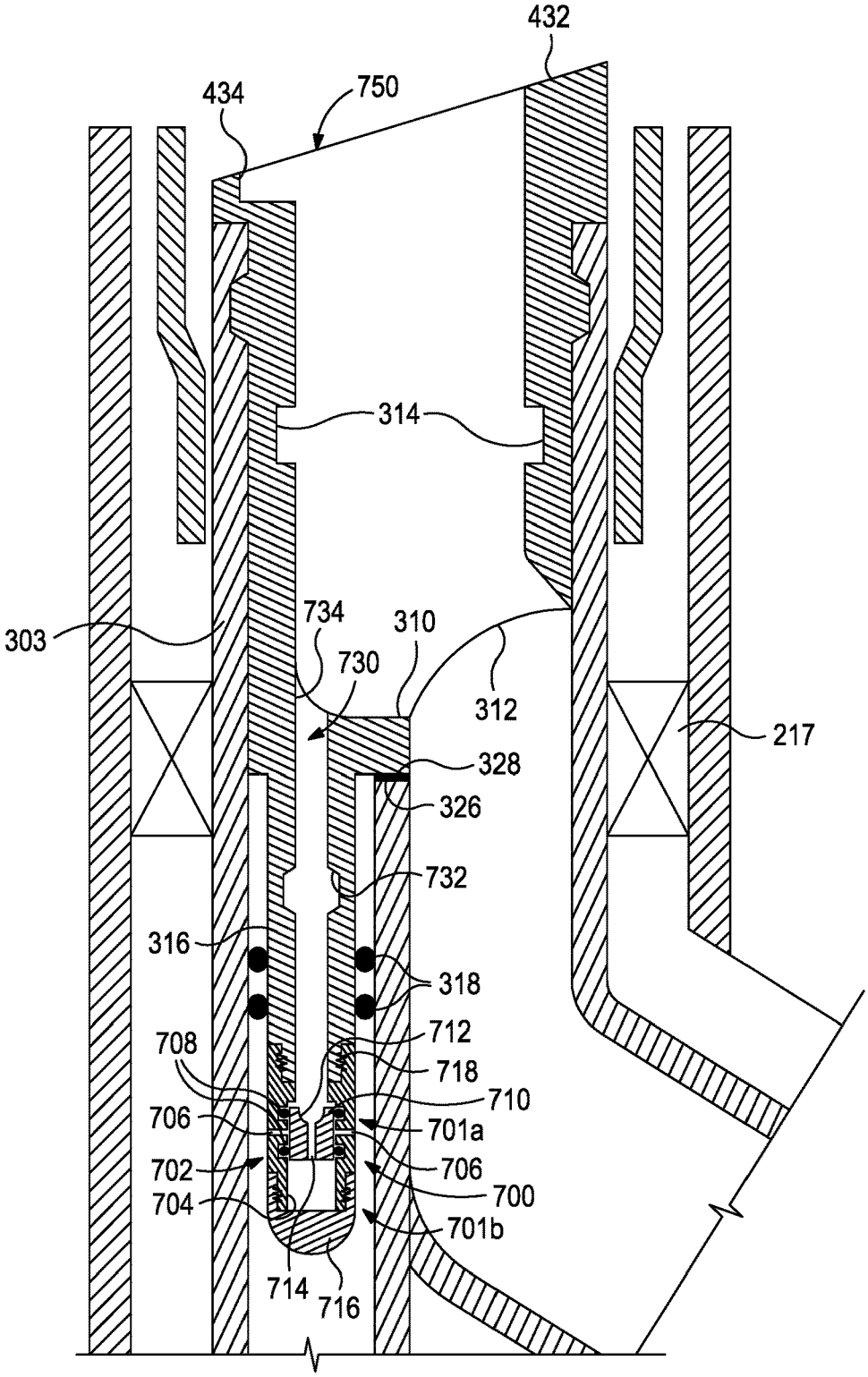
FIG. 7A schematically illustrates an exemplary plug deflector configured to equalize the pressure differential.

FIG. 7A schematically illustrates an exemplary plug deflector 750 configured to equalize the pressure differential. The plug deflector 750 may be similar in some respects to the plug deflector 402 of FIGS. 4A and 4B, and therefore may be best understood with reference thereto where like numerals designate like components not described again in detail. Although the plug deflector 750 is described with reference to the plug deflector 402, it will be obvious to those skilled in the art that any of the plug deflectors 302, 350, 402, 602, and/or 650 can be modified according to the plug deflector 750 to equalize the pressure differential.

As illustrated, a coupling mechanism 730 may be defined in the body 303 of the plug deflector 750 and may be used to receive or otherwise couple the plug deflector 750 to the downhole tool. As illustrated, the coupling mechanism 730 may comprise an inner bore 734 that extends axially through the body 303 of the plug deflector 750 from the deflector surface 310. The inner bore 734 may provide a uniquely profiled coupling surface 732 via which the plug deflector 750 can be engaged or otherwise coupled to the downhole tool to install and/or remove the plug deflector 750 from the Y-block 206. It should be noted that the coupling mechanism 730 and the profiled coupling surface 732 are not restricted to any particular shape or size and may have a desired shape and size via which the plug deflector 402 (FIG. 4A) can be installed and/or removed from the Y-block 206 (FIG. 4A).

The plug deflector 750 may further include a pressure equalizing device, for example, an equalizing valve 700, installed at or near the second end 304*b* (FIG. 4A) thereof. Suitable examples of the equalizing valve 700 include, but are not limited to, OTIS X® and R® RPT® and FBN® equalizing subs commercially available from Halliburton Energy Services, Inc., of Houston, Tex. As illustrated, the equalizing valve 700 may be secured within the plug 316 of the plug deflector 750. The equalizing valve 700 may include an elongated body 702 having a first end 701*a* and a second end 701*b* opposite the first end 701*a*. The equalizing valve 700 may be secured to the plug 316 via the first end 701*a*, for instance, via threads 718. The body 702 defines a central passageway 704 that extends axially through a central portion of the body 702 between the first end 701*a* and the second end 701*b*. The body 702 may define orifices 706 extending radially from the passageway 704 to the outer surface of the body 702. The orifices 706 may thus fluidly connect the passageway 704 to the interior of the main leg 210 (FIG. 4A).

Upper and lower sealing elements 708 may be positioned on opposing axial sides (i.e., uphole and downhole) of the orifices 706 and engage the inner surface of the passageway 704 to provide a seal that prevents fluids (e.g., hydraulic fluids, wellbore fluids, gases, etc.) from migrating across the sealing elements 708 in either axial direction.

A piston 710 may be positioned in the passageway 704 and may be movable between a first position adjacent the first end 701*a* and a second position adjacent the second end 701*b*. The piston 710 may define a coupling surface 712 configured to receive or otherwise engage with the downhole tool. For instance, the coupling surface 712 may comprise a uniquely profiled surface at an uphole end of the piston 710. The coupling surface 712 may be in fluidic communication with an orifice 714 extending from the coupling surface 712 to the downhole end of the piston 710. A bottom cap 716 may be secured to the equalizing valve 700 at or adjacent the second end 701*b*. The bottom cap 716 restricts further downhole movement of the piston 710 when moved by the down hole tool.

Figure 7B:
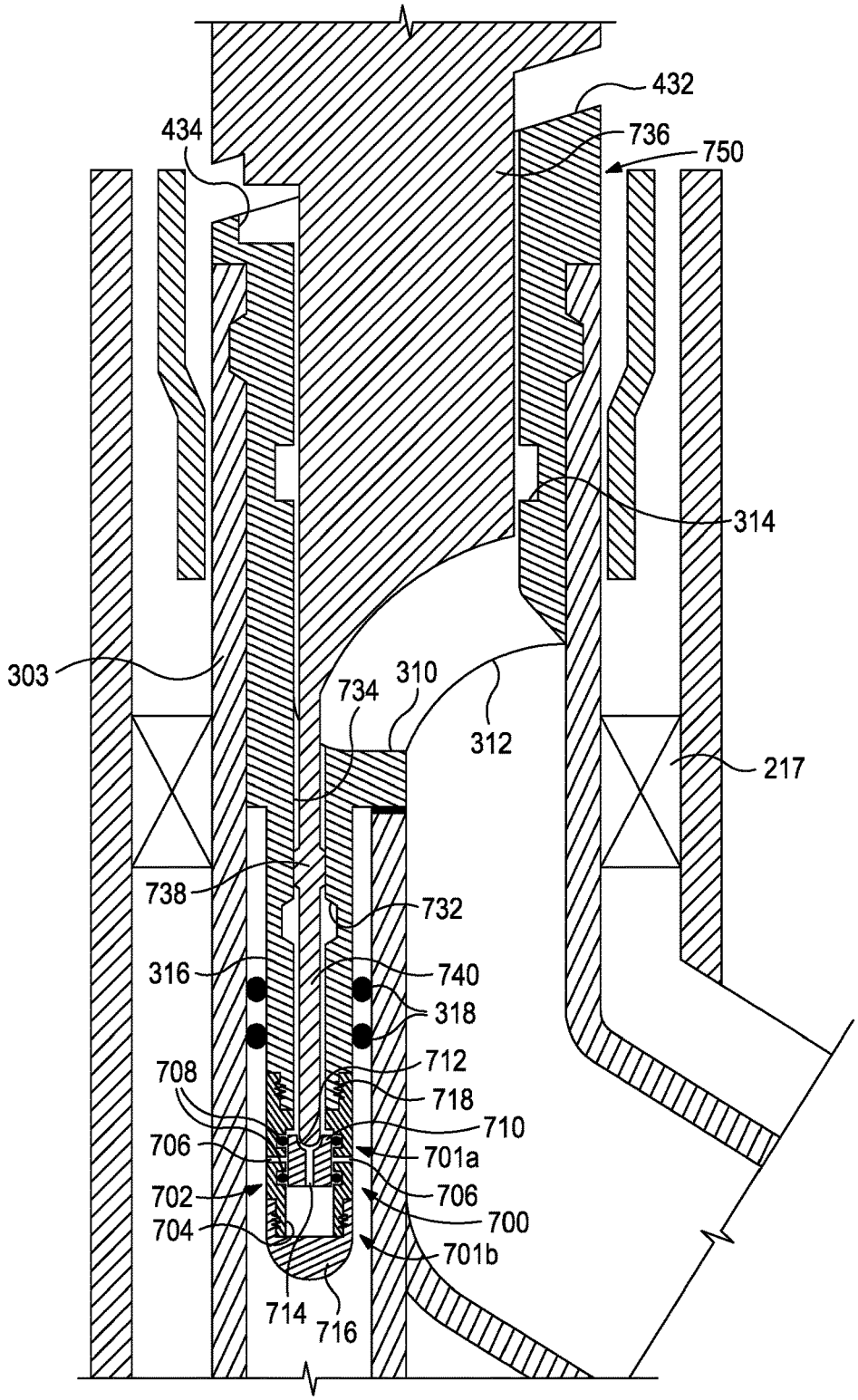
FIGS. 7B and 7C schematically illustrate progressive views of an operation for equalizing the pressure differential.
Figure 7C:
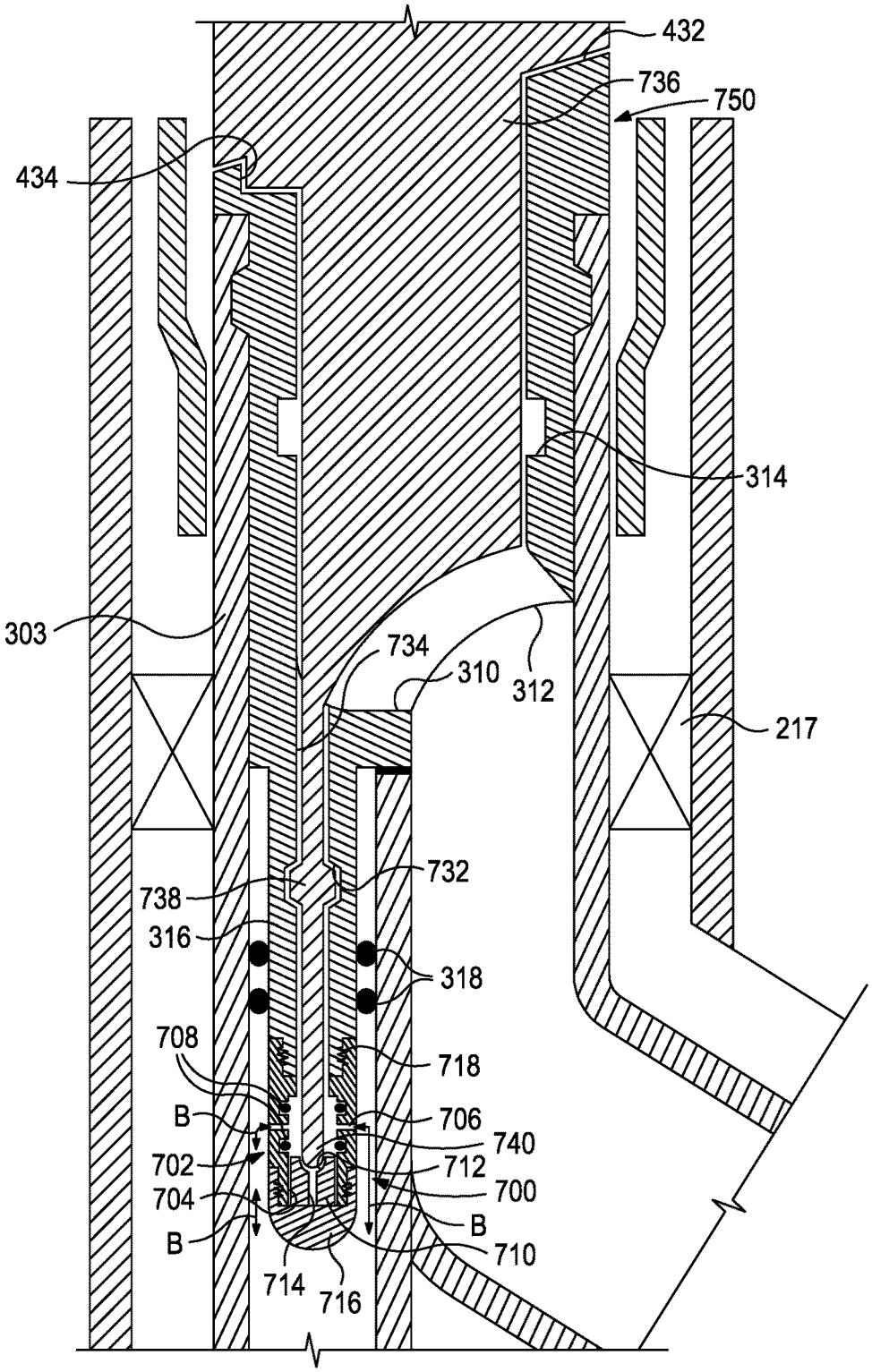

FIGS. 7B and 7C schematically illustrate progressive, cross-sectional views of the plug deflector 750 in equalizing the pressure differential across the sealing elements 318. During operation, the piston 710 may initially be positioned in a first position, wherein the piston 710 blocks the orifices 706 and thereby prevents communication between the passageway 704 and the interior of the main leg 210 (FIG. 4A). As illustrated in FIG. 7B, a downhole tool 736 including an engagement mechanism 738 may be received by the plug deflector 750. The engagement mechanism 738 may be configured to be received within the inner bore 734 defined in the body 303 to locate and couple to the coupling surface 732. The engagement mechanism 738 may have spring-loaded keys or lugs that correspond to the profile of the coupling surface 732. A leading end 740 of the downhole tool 736 may be configured to extend through the inner bore 734 to engage the coupling surface 712.

As illustrated in FIG. 7C, as the downhole tool 736 advances within the inner bore 734, the engagement mechanism 738 locates and is received by the coupling surfaces 732. Further axial movement of the downhole tool 736 may move the piston 710 to the second position, and thereby exposes the orifices 706 to establish fluid communication between the passageway 704 and the interior of the main leg 210 (FIG. 4A). As a result, the pressure differential across the sealing elements 318 is equalized, as indicated by the arrows B.

Although not expressly illustrated in FIGS. 7B and 7C, the downhole tool 736 may also include an orienting key similar to the orienting key 440 of FIG. 4B, and the plug deflector 750 may define a longitudinal groove similar to the longitudinal groove 434 of FIG. 4B for angularly orienting the downhole tool 736 to a predetermined angular orientation in the plug deflector 750.

Examples disclosed herein include:

A. A system that includes a Y-block positioned within a multi-lateral wellbore at a junction of a first wellbore and a second wellbore, the Y-block having a first leg fluidly coupled to the first wellbore and a second leg fluidly coupled to the second wellbore, and a plug deflector coupled to the Y-block and including, a body having a first end and a second end opposite the first end, a tool receptacle provided at the first end and defining an internal bore that defines a first coupling mechanism, at least one plug provided at the second end and extendable into the first or second legs, and a deflector surface provided at an intermediate location between the first and second ends.

B. A method that includes conveying a plug deflector into a multi-lateral wellbore, the plug deflector including, a body having a first end and a second end opposite the first end, a tool receptacle provided at the first end and defining an internal bore that defines a first coupling mechanism, at least one plug provided at the second end, and a deflector surface provided at an intermediate location between the first and second ends, extending the at least one plug into a Y-block secured within the multi-lateral wellbore, wherein the Y-block includes a first leg fluidly coupled to a first wellbore of the multi-lateral wellbore and a second leg fluidly coupled to a second wellbore extending from the first wellbore, and coupling the plug deflector to the Y-block.

C. A plug deflector that includes a body having a first end and a second end opposite the first end, a tool receptacle provided at the first end and defining an internal bore having a first coupling mechanism defined on the internal bore, at least one plug provided at the second end, and a deflector surface provided at an intermediate location between the first and second ends.

D. A method that includes coupling a plug deflector in a Y-block, the plug deflector including, a body having a first end and a second end opposite the first end, a tool receptacle provided at the first end and defining an internal bore that defines a coupling mechanism, at least one plug provided at the second end, and a deflector surface provided at an intermediate location between the first and second ends, the plug deflector being coupled in the Y-block by extending the at least one plug into the Y-block, conveying the Y-block including the plug deflector into a multi-lateral wellbore, and positioning the Y-block within the multi-lateral wellbore, wherein the Y-block includes a first leg fluidly coupled to a first wellbore of the multi-lateral wellbore and a second leg fluidly coupled to a second wellbore extending from the first wellbore.

Each of examples A, B, C and D may have one or more of the following additional elements in any combination: Element 1: wherein the first leg of the Y-block defines at least two flow paths and the plug deflector includes at least two plugs, and wherein each plug is extended into a corresponding one of the at least two flow paths.

Element 2: wherein the plug deflector is coupled to the Y-block using a mechanical fastener. Element 3: wherein the body defines a through hole extending axially from the deflector surface and a corresponding hole is defined in the Y-block, and wherein the mechanical fastener extends through the through hole to the corresponding hole to couple the plug deflector to the Y-block. Element 4: further comprising a coupling device provided at or adjacent the first or second ends to couple the plug deflector to the Y-block. Element 5: wherein the plug deflector includes at least two plugs and the coupling device is provided on each plug. Element 6: wherein the coupling device comprises a collet having a plurality of axially extending fingers and a radial projection provided on one or more of the plurality of axially extending fingers, and wherein the Y-block defines a collet profile to receive the radial projection of each axially extending finger and thereby secure the plug deflector to the Y-block. Element 7: further comprising a second coupling mechanism defined on the deflector surface. Element 8: further comprising, a no-go shoulder defined on the body, and a radial shoulder provided on the Y-block to receive the no-go shoulder and thereby prevent downhole movement of the plug deflector. Element 9: further comprising one or more sealing elements positioned to seal an interface between the at least one plug and an inner radial surface of the first or second leg. Element 10: further comprising a pressure equalizing device coupled to the at least one plug at the second end for equalizing a pressure differential across the one or more sealing elements. Element 11: further comprising, a muleshoe positioned in the Y-block and defining a tapering uphole surface and a groove that extends axially from the tapering uphole surface, and an orienting key positioned on an outer surface of the plug at or adjacent the second end to locate and slidingly engage the tapering uphole surface to azimuthally orient the plug deflector in the Y-block.

Element 12: wherein conveying the plug deflector into the multi-lateral wellbore includes conveying the plug deflector using a tool string having the plug deflector coupled thereto, and extending the at least one plug into the Y-block includes extending the at least one plug into the first leg of the Y-block to isolate the first wellbore, and the method further comprises, decoupling the tool string from the plug deflector, extending the tool string into the second wellbore, performing one or more wellbore operations in the second wellbore, pulling the tool string uphole and engaging the plug deflector with the tool string, and retrieving the plug deflector to a surface using the tool string. Element 13: wherein a pressure equalizing device is coupled to the at least one plug at the second end, and the method further comprises equalizing a pressure differential across one or more sealing elements positioned to seal an interface between the at least one plug and an inner radial surface of the first or second leg using the pressure equalizing device. Element 14: wherein conveying the plug deflector into the multi-lateral wellbore includes conveying the plug deflector using a first tool string having the plug deflector coupled thereto, and extending the at least one plug into the Y-block includes extending the at least one plug into the first leg of the Y-block to isolate the first wellbore, and the method further comprises, decoupling the first tool string from the plug deflector, and retrieving the first tool string to a surface. Element 15: further comprising, conveying a second tool string into the second wellbore, and performing one or more wellbore operations in the second wellbore. Element 16: wherein the plug deflector includes at least two plugs and the Y-block defines at least two flow paths, the method further comprising extending each plug into a corresponding one of the at least two flow paths. Element 17: wherein the body defines a through hole extending axially from the deflector surface and a corresponding hole is defined in the Y-block, and wherein coupling the plug deflector to the Y-block comprises, extending a mechanical fastener through the through hole to the corresponding hole to couple the plug deflector to the Y-block. Element 18: wherein a coupling device is provided at or adjacent the first or second ends and comprises a collet having a plurality of axially extending fingers and a radial projection provided on one or more of the plurality of axially extending fingers, and wherein coupling the plug deflector to the Y-block comprises, securing the plug deflector to the Y-block by receiving the radial projection of each axially extending finger in a collet profile defined in the Y-block. Element 19: wherein a second coupling mechanism is defined on the deflector surface, and the method further comprises coupling the plug deflector via the second coupling mechanism. Element 20: wherein a no-go shoulder is defined on the body and a radial shoulder is provided on the Y-block and coupling the plug deflector to the Y-block comprises, receiving the no-go shoulder using the radial shoulder and thereby preventing downhole movement of the plug deflector. Element 21: wherein a muleshoe is positioned in the Y-block and defines a tapering uphole surface and a groove that extends axially from the tapering uphole surface, and an orienting key is positioned on an outer surface of the at least one plug at or adjacent the second end, and wherein coupling the plug deflector to the Y-block comprises, locating and slidingly engaging the tapering uphole surface with the orienting key to azimuthally orient the plug deflector in the Y-block.

Element 22: further comprising at least two plugs provided at the second end. Element 23: further comprising a second coupling mechanism defined on the deflector surface. Element 24: further comprising a coupling device including a collet having a plurality of axially extending fingers and a radial projection provided on one or more of the plurality of axially extending fingers.

Element 25: wherein the plug deflector includes at least two plugs and the first leg of the Y-block defines at least two flow paths, and the method further comprises coupling the plug deflector in the first leg by extending each plug into a corresponding one of the at least two flow paths. Element 26: wherein conveying the Y-block including the plug deflector includes conveying the Y-block in the multi-lateral wellbore using a tool string having the plug deflector coupled thereto, and the plug deflector is coupled in the Y-block by extending the at least one plug into the first leg of the Y-block to isolate the first wellbore, and the method further comprises, decoupling the tool string from the plug deflector, extending the tool string into the second wellbore, performing one or more wellbore operations in the second wellbore using the tool string, pulling the tool string uphole and engaging the plug deflector with the tool string, and retrieving the plug deflector to a surface using the tool string.

By way of non-limiting example, exemplary combinations applicable to A, B, C, and D include: Element 2 with Element 3; Element 4 with Element 5; Element 4 with Element 6; Element 12 with Element 13; and Element 14 with Element 15.

Therefore, the disclosed systems and methods are well adapted to attain the ends and advantages mentioned as well as those that are inherent therein. The examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the illustrative examples disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A system comprising:

a Y-block positioned within a multi-lateral wellbore at a junction of a first wellbore and a second wellbore, the Y-block having a first leg fluidly coupled to the first wellbore and a second leg fluidly coupled to the second wellbore; and a plug deflector coupled to the Y-block and including:

a body having a first end and a second end opposite the first end;

a tool receptacle provided at the first end and defining an internal bore that defines a first coupling mechanism;

at least one plug provided at the second end and extendable into the first or second legs; and a deflector surface provided at an intermediate location between the first and second ends.

2. The system of claim 1, wherein the first leg of the Y-block defines at least two flow paths and the plug deflector includes at least two plugs, and wherein each plug is extended into a corresponding one of the at least two flow paths.

3. The system of claim 1, wherein the plug deflector is coupled to the Y-block using a mechanical fastener.

4. The system of claim 3, wherein the body defines a through hole extending axially from the deflector surface and a corresponding hole is defined in the Y-block, and wherein the mechanical fastener extends through the through hole to the corresponding hole to couple the plug deflector to the Y-block.

5. The system of claim 1, further comprising a coupling device provided at or adjacent the first or second ends to couple the plug deflector to the Y-block.

6. The system of claim 5, wherein the plug deflector includes at least two plugs and the coupling device is provided on each plug.

7. The system of claim 5, wherein the coupling device comprises a collet having a plurality of axially extending fingers and a radial projection provided on one or more of the plurality of axially extending fingers, and wherein the Y-block defines a collet profile to receive the radial projection of each axially extending finger and thereby secure the plug deflector to the Y-block.

8. The system of claim 1, further comprising a second coupling mechanism defined on the deflector surface.

9. The system of claim 1, further comprising:

a no-go shoulder defined on the body; and a radial shoulder provided on the Y-block to receive the no-go shoulder and thereby prevent downhole movement of the plug deflector.

10. The system of claim 1, further comprising one or more sealing elements positioned to seal an interface between the at least one plug and an inner radial surface of the first or second leg.

11. The system of claim 10, further comprising a pressure equalizing device coupled to the at least one plug at the second end for equalizing a pressure differential across the one or more sealing elements.

12. The system of claim 1, further comprising:

a muleshoe positioned in the Y-block and defining a tapering uphole surface and a groove that extends axially from the tapering uphole surface; and an orienting key positioned on an outer surface of the plug at or adjacent the second end to locate and slidingly engage the tapering uphole surface to azimuthally orient the plug deflector in the Y-block.

13. A method comprising:

conveying a plug deflector into a multi-lateral wellbore, the plug deflector including:

a body having a first end and a second end opposite the first end;

a tool receptacle provided at the first end and defining an internal bore that defines a first coupling mechanism;

at least one plug provided at the second end; and a deflector surface provided at an intermediate location between the first and second ends;

extending the at least one plug into a Y-block secured within the multi-lateral wellbore, wherein the Y-block includes a first leg fluidly coupled to a first wellbore of the multi-lateral wellbore and a second leg fluidly coupled to a second wellbore extending from the first wellbore; and coupling the plug deflector to the Y-block.

14. The method of claim 13, wherein conveying the plug deflector into the multi-lateral wellbore includes conveying the plug deflector using a tool string having the plug deflector coupled thereto, and extending the at least one plug into the Y-block includes extending the at least one plug into the first leg of the Y-block to isolate the first wellbore, and the method further comprises:

decoupling the tool string from the plug deflector;

extending the tool string into the second wellbore;

performing one or more wellbore operations in the second wellbore;

pulling the tool string uphole and engaging the plug deflector with the tool string; and retrieving the plug deflector to a surface using the tool string.

15. The method of claim 13, wherein conveying the plug deflector into the multi-lateral wellbore includes conveying the plug deflector using a first tool string having the plug deflector coupled thereto, and extending the at least one plug into the Y-block includes extending the at least one plug into the first leg of the Y-block to isolate the first wellbore, and the method further comprises:

decoupling the first tool string from the plug deflector; and retrieving the first tool string to a surface.

16. The method of claim 15, further comprising:

conveying a second tool string into the second wellbore; and performing one or more wellbore operations in the second wellbore.

17. The method of claim 13, wherein the plug deflector includes at least two plugs and the Y-block defines at least two flow paths, the method further comprising extending each plug into a corresponding one of the at least two flow paths.

18. The method of claim 13, wherein the body defines a through hole extending axially from the deflector surface and a corresponding hole is defined in the Y-block, and wherein coupling the plug deflector to the Y-block comprises:

extending a mechanical fastener through the through hole to the corresponding hole to couple the plug deflector to the Y-block.

19. The method of claim 13, wherein a coupling device is provided at or adjacent the first or second ends and comprises a collet having a plurality of axially extending fingers and a radial projection provided on one or more of the plurality of axially extending fingers, and wherein coupling the plug deflector to the Y-block comprises:

securing the plug deflector to the Y-block by receiving the radial projection of each axially extending finger in a collet profile defined in the Y-block.

20. The method of claim 13, wherein a second coupling mechanism is defined on the deflector surface, and the method further comprises coupling the plug deflector via the second coupling mechanism.

21. A plug deflector comprising:

a body having a first end and a second end opposite the first end;

a tool receptacle provided at the first end and defining an internal bore having a first coupling mechanism defined on the internal bore;

at least one plug provided at the second end;

a deflector surface provided at an intermediate location between the first and second ends; and a second coupling mechanism defined on the deflector surface.

22. The plug deflector of claim 21, further comprising at least two plugs provided at the second end.

23. A plug deflector comprising:

a body having a first end and a second end opposite the first end;

a tool receptacle provided at the first end and defining an internal bore having a first coupling mechanism defined on the internal bore;

at least one plug provided at the second end;

a deflector surface provided at an intermediate location between the first and second ends; and a coupling device including a collet having a plurality of axially extending fingers and a radial projection provided on one or more of the plurality of axially extending fingers.

24. A method comprising:

coupling a plug deflector in a Y-block, the plug deflector including:

a body having a first end and a second end opposite the first end;

a tool receptacle provided at the first end and defining an internal bore that defines a coupling mechanism;

at least one plug provided at the second end; and a deflector surface provided at an intermediate location between the first and second ends, the plug deflector being coupled in the Y-block by extending the at least one plug into the Y-block;

conveying the Y-block including the plug deflector into a multi-lateral wellbore; and positioning the Y-block within the multi-lateral wellbore, wherein the Y-block includes a first leg fluidly coupled to a first wellbore of the multi-lateral wellbore and a second leg fluidly coupled to a second wellbore extending from the first wellbore.

25. The method of claim 24, wherein the plug deflector includes at least two plugs and the first leg of the Y-block defines at least two flow paths, and the method further comprises coupling the plug deflector in the first leg by extending each plug into a corresponding one of the at least two flow paths.

26. The method of claim 24, wherein conveying the Y-block including the plug deflector includes conveying the Y-block in the multi-lateral wellbore using a tool string having the plug deflector coupled thereto, and the plug deflector is coupled in the Y-block by extending the at least one plug into the first leg of the Y-block to isolate the first wellbore, and the method further comprises:

decoupling the tool string from the plug deflector;

extending the tool string into the second wellbore;

performing one or more wellbore operations in the second wellbore using the tool string;

pulling the tool string uphole and engaging the plug deflector with the tool string; and retrieving the plug deflector to a surface using the tool string.

* * * * *